US006229979B1

(12) United States Patent
Ishii et al.

(10) Patent No.: US 6,229,979 B1
(45) **Date of Patent: *May 8, 2001**

(54) DEVELOPING CHARGING MEMBER SUPPLIED WITH A VOLTAGE OF A SAME POLARITY AS THAT OF A DEVELOPER AND NOT LESS THAN A CHARGE STARTING VOLTAGE AND A DEVELOPING CHARGING ROLLER WITH INTERNAL BEARING

(75) Inventors: Yasuyuki Ishii, Mishima; Tadayuki Tsuda, Susono; Shinichi Sasaki, Shizuoka-ken; Kanji Yokomori, Odawara; Kouji Hashimoto, Shizuoka-ken; Toru Oguma, Mishima; Nobuharu Hoshi, Numazu, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/167,723

(22) Filed: Oct. 7, 1998

(30) Foreign Application Priority Data

| | | |
|---|---|---|
| Oct. 9, 1997 | (JP) | 9-293305 |
| Oct. 9, 1997 | (JP) | 9-293306 |
| Nov. 6, 1997 | (JP) | 9-320442 |
| Nov. 7, 1997 | (JP) | 9-322207 |

(51) Int. Cl.[7] ..... G03G 15/08
(52) U.S. Cl. ..... 399/281; 399/284
(58) Field of Search ..... 399/270–272, 399/274, 281, 284, 285

(56) References Cited

U.S. PATENT DOCUMENTS

| | | | |
|---|---|---|---|
| 4,835,565 | 5/1989 | Shinzi et al. . | |
| 5,272,505 | 12/1993 | Shishido et al. . | |
| 5,887,233 * | 3/1999 | Abe et al. | 399/284 |

FOREIGN PATENT DOCUMENTS

| | | |
|---|---|---|
| 0 388 191 | 9/1990 | (EP) . |
| 36-10231 | 7/1936 | (JP) . |
| 54-43038 | 4/1979 | (JP) . |
| 59-53856 | 3/1984 | (JP) . |
| 60-083972 | 5/1985 | (JP) . |
| 3-073979 | 3/1991 | (JP) . |

* cited by examiner

*Primary Examiner*—William J. Royer
(74) *Attorney, Agent, or Firm*—Fitzpatrick, Cella, Harper & Scinto

(57) ABSTRACT

A developing device includes a developing container for accommodating a developer; a developer carrying member, disposed in an opening of the developing container, for carrying a developer; a developer charging member for being contacted to the developer on the developer carrying member and supplied with a voltage of the same polarity as the developer and not less than a discharge start voltage.

34 Claims, 24 Drawing Sheets

DEVELOPING CHARGING MEMBER SUPPLIED WITH A VOLTAGE OF A SAME POLARITY AS THAT OF A DEVELOPER AND NOT LESS THAN A CHARGE STARTING VOLTAGE AND A DEVELOPING CHARGING ROLLER WITH INTERNAL BEARING

FIELD OF THE INVENTION AND RELATED ART

The present invention relates to a developing device for developing an electrostatic image on an image bearing member, for an image forming apparatus such as a copying machine or a printer of an electrophotographic type or electrostatic recording type.

In an electrophotographic type image forming apparatus, an electrostatic latent image formed on the image bearing member is visualized into a toner image by a developing device.

One of such a developing device is a dry type one component developing device of various type. In any of them, it is difficult to form a thin layer of toner which is a one-component developer, on a developer carrying member.

On the other hand, improvement of resolution of an image and a sharpness or the like are recently desired, and further improvement in the thin layer formation method is desired.

For example, as disclosed in Japanese Laid-open Patent Application No. SHO 54-43038, an elastic blade, functioning as a regulating member, of a material such as metal and rubber is contacted to a developing sleeve which is a developer carrying member, and the toner is passed through the contact portion between the elastic blade and the developing sleeve, by which a thin layer of the toner having a regulated thickness is formed, and sufficient triboelectric charge is applied to the toner by the friction in the contact portion.

In this case, when the non-magnetic toner is regulated by the elastic blade, a toner supply member for supplying the toner onto the developing sleeve is additionally required. In the case of magnetic toner, the toner can be supplied onto the developing sleeve by the magnetic force of the magnet in the developing sleeve, but in the case of non-magnetic toner, the supply of the toner is not possible by magnetic force.

Then, a developing device 50 as shown in FIG. 15 has been proposed. In this developing device 50, an elastic roller 55 of a foam member or a fur brush of polyurethane foam, sponge or the like is contacted to the developing sleeve 52 at a position upstream of an elastic blade 51 with respect to a rotational direction of the developing sleeve 52, in a developing container 54 accommodating non-magnetic toner 53 as an one-component developer, and is rotated in a direction indicated by an arrow D, by which the toner 53 is supplied to the developing sleeve 52.

The toner 53 supplied to the developing sleeve 52 is fed to the contact portion between the elastic blade 51 and the developing sleeve 52 with the rotation of the developing sleeve 52, and is formed into a thin layer, and fed for development of an electrostatic latent image on a photosensitive member 1 which is an image bearing member. The toner 53 remaining on the developing sleeve 52 without being consumed for development, is removed by the elastic roller 55, and a fresh toner 53 is supplied to the developing sleeve 52 by the elastic roller 55, and this is repeated. When the material of the developing sleeve 52 is metal, it is not preferable to use a thin plate for an elastic blade 51 in view of wearing effect thereof, and it is desired to use a rubber material such as urethane or silicon to provide a thin toner layer.

With such a structure, a thin layer formation of non-magnetic toner on the developing sleeve is made possible. FIG. 16 is a view of a developing device 50 of FIG. 15 as seen from the photosensitive member 1, wherein the developing sleeve 52 is omitted for better understanding, and the contact nip between the elastic blade 51 and the developing sleeve 52 is indicated by hatching lines.

As shown in FIG. 16, an end seal member 57 is provided in a gap between the opening of the developing container 54 and each of the opposite ends of the developing sleeve 52, the end seal member 57 being of fiber material such as a wool felt or Teflon pile, or of polyurethane foam, sponge rubber or the like to prevent leakage of the toner through the gap between the developing container 54 and the opposite longitudinal end portions of the developing sleeve 52; and in addition, as shown in FIG. 16, the elastic blade 51 is nipped between the developing sleeve 52 and the end seal member 57 at the opposite ends (in other words, by urging the back side of the elastic blade 51 by the end seal member 57) to prevent the leakage of the toner at the opposite ends of the elastic blade 51.

However, with such a structure, it is necessary to press-contact the end seal member 57 to the developing sleeve 52 with a quite high pressure to assure the sealing property, with the result that elastic blade 51 nipped between the developing sleeve 52 and the end seal member 57 is deformed as if it follows the peripheral surface of the developing sleeve 52 from the nip of the developing sleeve 52 at the opposite ends to the edge portion.

As a result, the longitudinally inside end portion of the elastic blade 51 tends to separate, and therefore, the developer layer formed on the developing sleeve 52 at these portions are thicker than the other portion, and the charging of the toner 53 becomes low. Thus, the charging is non-uniform in the longitudinal direction of the developing sleeve 52, and therefore, when a voltage (developing bias) is applied to the developing sleeve 52 during the developing operation, and the toner 53 may transfer from the opposite ends of the developing sleeve 52 to the photosensitive member 1, resulting in a foggy image, and/or in non-uniformity in the image density due to the non-uniformity of the amount of the charge of the toner on the developing sleeve 52.

As a solution to this problem, it would be considered to provide an inclined cut portion at each of the opposite ends of the elastic blade. As shown in FIG. 17, a distance from a most downstream point, with respect to a rotational direction of the developing sleeve, of a nip between an elastic blade 58 and the developing sleeve 52 to the free end of the elastic blade 58, is continuously reduced toward the end adjacent each of the opposite longitudinal ends of the elastic blade 58, and at least the free end portion at the end portion is in the contact nip. Therefore, even if the longitudinally inside end portion of the elastic blade 51 separates, and therefore, the developer layer formed on the developing sleeve 52 at these portions are thicker than the other portion, as mentioned above, the toner leakage is prevented at the opposite ends of the elastic blade 58 and the developing sleeve 52 since the contact nip is small, and an edge contact tends to occur. In addition, the thin layer of the non-magnetic toner can be satisfactorily formed on the developing sleeve 52, and the electrostatic latent image can be developed satisfactorily on the photosensitive member 1 (image bearing member).

However, when the developing operation is repeated may times with the developing device, the toner 53 tends to be packed at the opposite ends of the elastic blade 58 as compared with the central portion, since the pressure (force per unit area) is large in the end portions. By the packing, the elastic blade 58 is raised at the opposite ends of the nip with the result that the toner layer becomes gradually thick on lines. The electrical attraction force(mirror force) onto the developing sleeve 52 decreases, with the result of deposition of the toner 53 to the photosensitive member 1 as fog, or the toner 53 falls from the surface to the developing sleeve 52, thus remarkably contaminating the inside of the image forming apparatus (toner leakage).

On the inclined cut portions of the elastic blade 58 at the opposite ends, the toner 53 fed by the rotation of the developing sleeve 52 is accumulated, and the toner 53 moves toward the ends with many developing operations repeated. Such toner 53 enters through the small gaps, formed by the end seal member 57, each of the opposite ends of the elastic blade 58 and the developing sleeve 52. As a result, the surface area of the end seal member 57 contacted to the developing sleeve 52 is gradually rubbed with the toner 53, with the result that developing sleeve 52 is scraped by the rubbing between the end seal member 57 and the developing sleeve 52. If the developing sleeve 52 is scraped, the charging of the toner 53 is decreased, and the electrical attraction force(mirror force) to the developing sleeve 52 decreases, with the result that toner 53 may be deposited to the photosensitive member 1 as a fog, or the toner 53 falls from the surface of the developing sleeve 52 to the outside, thus contaminating the inside of the image forming apparatus.

The decrease of the charge amount of the toner is particularly large under high temperature and high humidity ambiences.

Spherical toner particles having smooth surfaces (shape factor SF-1 is 100–180, and shape factor SF-2 is 100 to 140) are quite widely used because a good image transfer property at the time of transferring the image from the image bearing member onto the transfer material by unshown transferring means, and because of a lubricity at the time of cleaning the image bearing member by cleaning means such as a blade and fur brush to remove the untransferred toner remaining on the image bearing member without being transferred, and further because the wearing with the image bearing member is low. However, the above-described movement of the toner at the end is remarkable since the flowability of such toner is high.

Therefore, the inclined cutting which is highly advantages still have a point to be improved in view of the requirement for the end member seal member is strict.

SUMMARY OF THE INVENTION

Accordingly, it is a principal object of the present invention to provide a developing device wherein a sealing property at an end of the developer carrying member is high.

It is another object of the present invention to provide a developing device which can provide the developer with high charge even under high temperature and high humidity ambiences.

It is a further object of the present invention to provide a developing device which can provide a developer with high charge at end portions of a developer carrying member.

According to an aspect of the present invention, there is provided a developing apparatus comprising:

A developing container for accommodating a developer;

A developer carrying member, provided in an opening of said developing container, for carrying a developer;

A developer charging member for being contacted to the developer on said developer carrying member and supplied with a voltage of the same polarity as the developer and not less than a discharge start voltage.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the embodiments of the present invention will be described.

<Embodiment 1>

Referring to FIGS. 1 to 10, Embodiment 1 of the present invention will be described.

Figure 1:
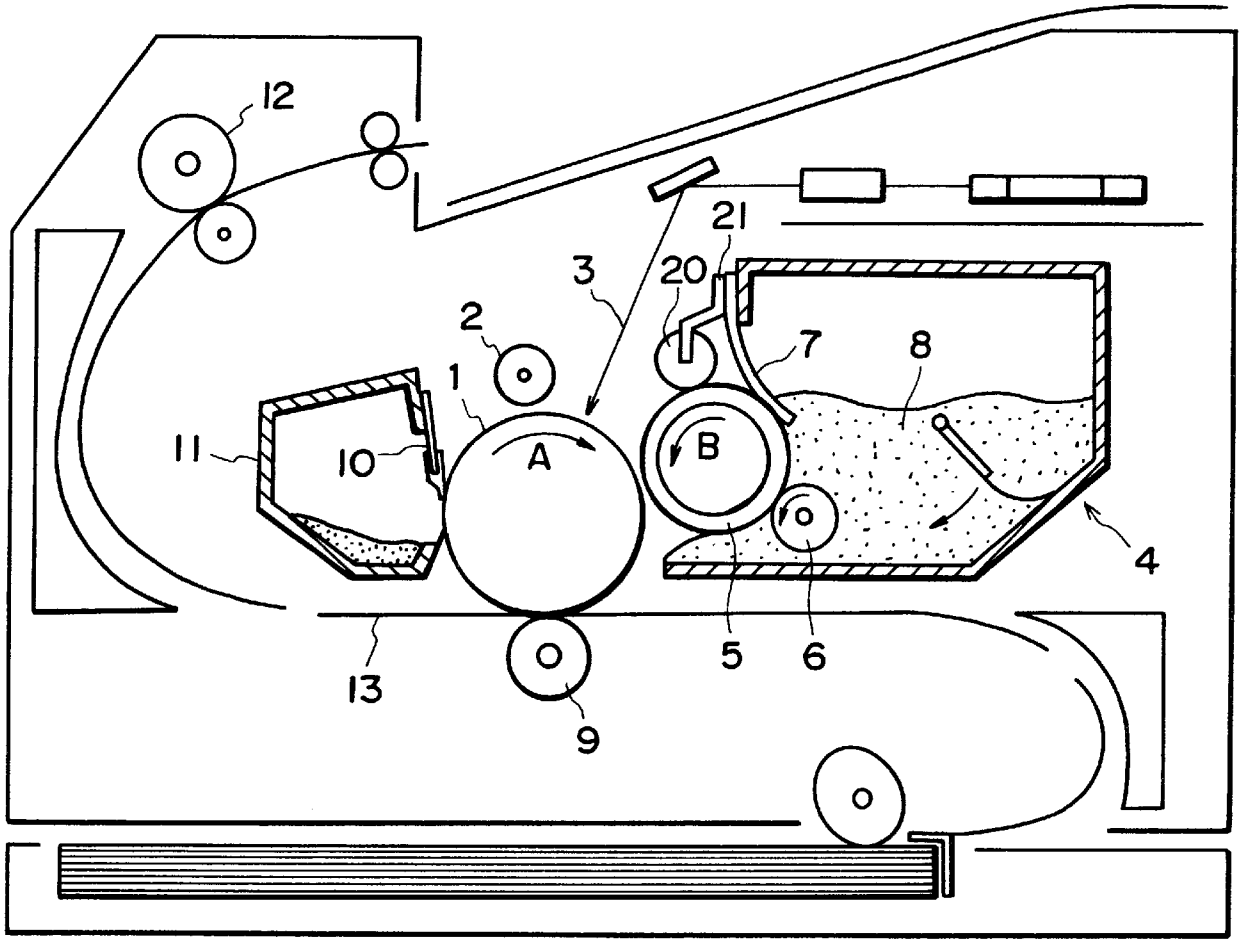
FIG. 1 is a schematic illustration of an image forming apparatus using a developing device according to Embodiment 1.

In an image forming apparatus of this embodiment shown in FIG. 1, a photosensitive drum 1 (image bearing member) is rotated in a direction indicated by an arrow A, and is uniformly charged by a charging device 2 for charging the photosensitive drum 1, and an electrostatic latent image is formed on a surface by a laser beam 3 (exposure means) to write an electrostatic latent image on the photosensitive drum 1.

The electrostatic latent image is visualized into a toner image by developing it by a developing device 4 (process cartridge) which is disposed adjacent to the photosensitive drum 1 and which is detachably mountable relative to the main assembly of the image forming apparatus. In this embodiment, a so-called reverse development is used, which deposits the toner onto the portion of the photosensitive drum which have been exposed to the light.

The toner image visualized on the photosensitive drum 1 is transferred onto paper 13 (recording material) by a transfer roller 9, and untransferred toner remaining on the photosensitive drum 1 is removed by a cleaning blade 10, and is accommodated in the residual toner container 11, and the photosensitive drum 1 having been subjected to the cleaning operation, is repeatedly used.

On the other hand, the paper 13 having received a toner image is fixed by a fixing device 12, and is then discharged to outside the apparatus.

Figure 2:
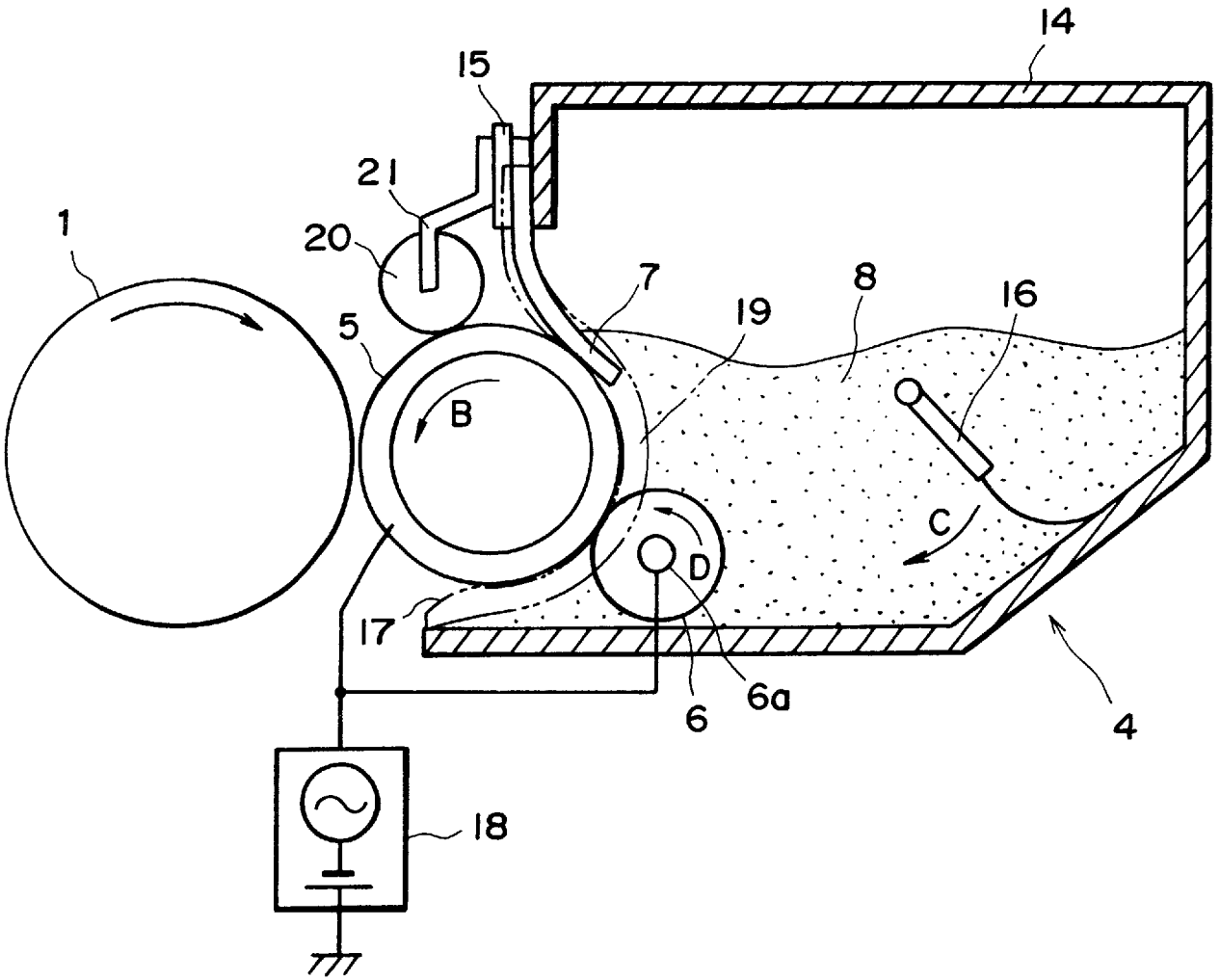
FIG. 2 is a schematic illustration of a developing device according to Embodiment 1.

Referring to FIG. 2, the developing device 4 of this embodiment will be described in detail.

As shown in FIG. 2, the developing device 4 comprises a developing container 14 accommodating insulative non-magnetic toner 8 (an one-component developer), and a developing sleeve 5 (developer carrying member) opposed to the photosensitive drum 1 and disposed in an opening elongated in a longitudinal direction of the developing container 14, and an electrostatic latent image of the photosensitive drum 1 is developed into a visualized image.

Substantially a half (right) of the developing sleeve 5 is in the developing container 14, and substantially a half (left) thereof is exposed to the outside of the developing container 14. The exposed surface is opposed to the photosensitive drum 1 with a small gap.

The developing sleeve 5 is rotated in a direction indicated by an arrow B, and the surface thereof is roughened to a proper degree to feed the toner 8 effectively and to enhance the chance of rubbing with the toner 8. The aluminum surface of the developing sleeve 5 having a diameter of 16 mm has been subjected to a blasting treatment with a regular blast particles (glass beads(#600)) into a surface roughness Rz of approximately 3 $\mu$m, and the gap from the photosensitive drum 1 is approximately 300 $\mu$m. It is rotated at a peripheral speed of 80 mm/s which is slightly higher than a peripheral speed of 50 mm/s of the photosensitive drum 1.

In order to prevent the toner leakage at the opposite ends of the developing sleeve 5, end seal members 19 are provided in the developing container opening to seal the opposite ends of the developing sleeve 5. Above the developing sleeve 5, an elastic blade 7 (regulating member) is supported on a blade supporting metal plate 15, and a part thereof adjacent the free end is surface-contacted to the outer surface of the developing sleeve 5 counterdirectionally (the free end is upstream of the contact portion relative to the rotational direction of the developing sleeve 5). The elastic blade 7 comprises rubber material such as urethane and silicon or includes a base member of an upper part position of SUS or phosphor bronze having a spring elasticity and a rubber material on the side of the base member contacted to the developing sleeve 5.

The elastic blade 7 of this embodiment includes a blade supporting metal plate 15 and an urethane rubber in the form of a plate having a thickness of 1.0 mm bonded thereto. The contact force relative to the developing sleeve 5 is 23–35 g/cm (the line pressure is measured in this manner: three thin metal plates having known friction coefficients are inserted into the contact portion, and the center portion one is pulled out through a spring weigher, and the read of the spring weigher is converted)

An elastic roller 6 is disposed upstream of the contact portion between the elastic blade 7 and the surface of the developing sleeve 5 with respect to the rotational direction of the sleeve 5, and is supported rotatably.

The structure thereof is preferably, a foam skeleton sponge structure, or a fur brush structure having a metal core and fibers of rayon, Nylon or the like planted therein, from the standpoint of supply of the toner 8 onto the developing sleeve 5 and removal of the toner not used for the development. In this embodiment, use is made of an elastic roller 6 having a diameter of 12 mm including a metal core 6*a* and polyurethane foam thereon. A width of the nip between the elastic roller 6 and the developing sleeve 5 is preferably 1–8 mm, and it is preferable to provide a relative speed relative to the developing sleeve 5 at the contact portion. In this embodiment, the width is 3 mm, and the elastic roller 6 is rotated at a peripheral speed of 50 mm/s during the developing operation (the relative speed relative to the developing sleeve 5 is 130 mm/s) by unshown driving means at predetermined timing.

Figure 3:
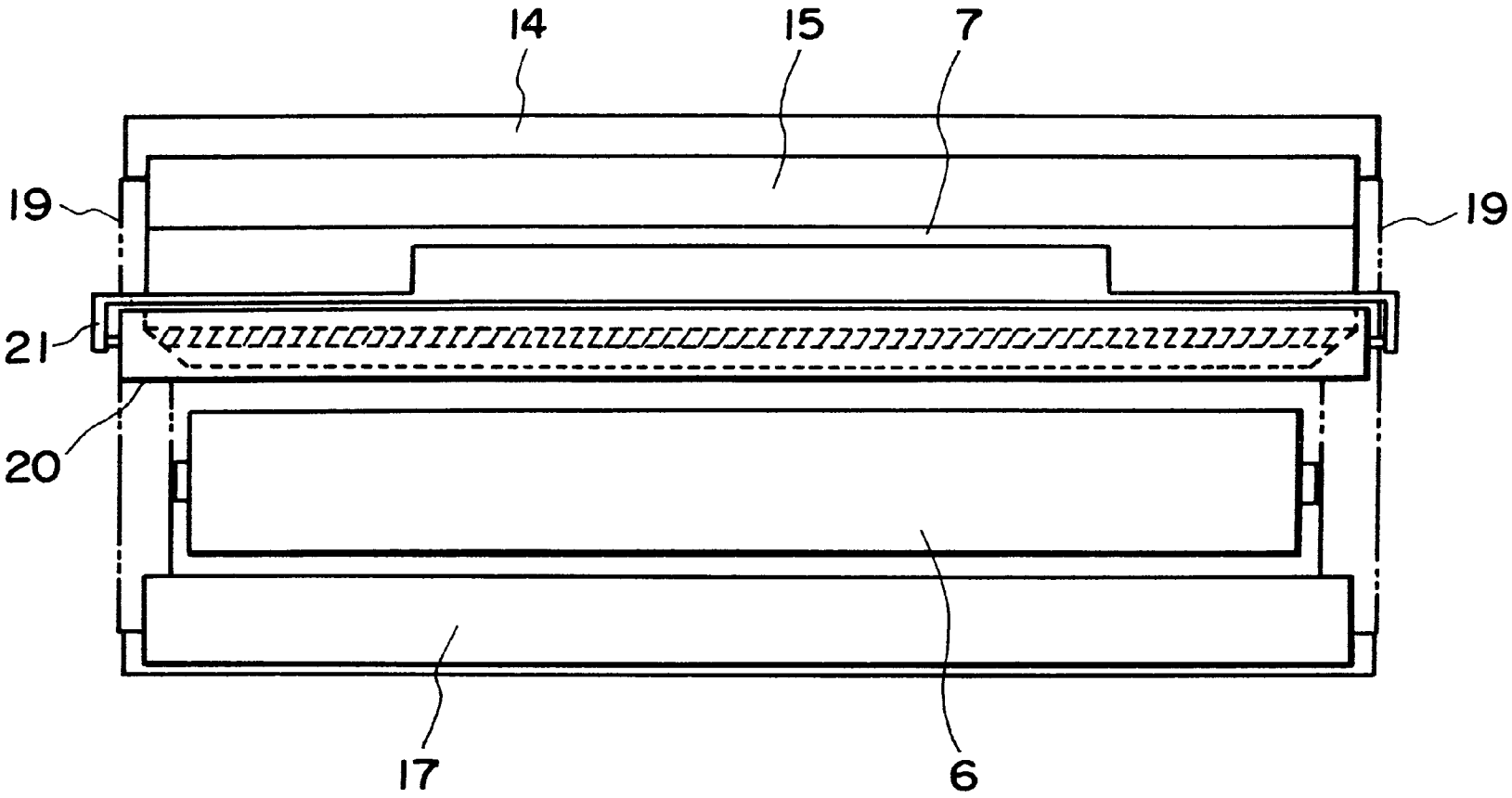
FIG. 3 is a view of the developing device of Embodiment 1 as seen from the photosensitive member wherein the developing sleeve is omitted for better understanding.

FIG. 3 is a view of the developing device 4 of FIG. 2 as seen from the upper part of the photosensitive member, and the developing sleeve 5 is omitted for better understating.

As shown in FIG. 3, the distance to the edge of the elastic blade 7 from the contact nip with the developing sleeve 5 indicated by the hatched portion in the Figure, continuously decreases from the central developing zone toward the opposite ends of the elastic blade 7, and the end position of the elastic blade 7 at the opposite ends is in the contact nip.

The thickness of the toner layer formed on the developing sleeve 5 is thicker if the distance from the upstream end of the contact nip in the rotational direction of the developing sleeve 5 to the edge is longer, as is known. In this embodiment, such a distance is made shorter in the portion in the end portion than in the normal developing zone, by the portion contacting to the surface of the developing sleeve corresponding to the non-contact portion in the longitudinal direction of the elastic roller 6.

The toner 8 is a nonmagnetic one component developer, and spherical toner particles having smooth surfaces are used because a good image transfer property at the time of transferring the image from the image bearing member onto the transfer material, and because of a lubricity at the time of cleaning the image bearing member by cleaning means such as a blade and fur brush to remove the untransferred toner remaining on the image bearing member without being transferred, and further because the wearing with the image bearing member is low. More particularly, the volume resistivity of the toner is $10^{14}\Omega$. The measuring conditions of the resistivity are such that area of the measuring electrode plate is 0.238 $cm^2$; the pressure is 980/$cm^2$ (96.1 kPa) provided by weight of 1500 g having a diameter of 6 mm; the layer thickness of the powder during the measurement is 0.5–1.0 mm; the voltage applied is a DC voltage of 400V; and the current is measured by a small current ammeter (YHP4140pAMETER/DCVOLTAGESOUCE). The volume resistivity(resistivity) is calculated from the resistance value.

The shape factor is such that SF-1 is 100–180, and SF-2 is 100–140. The SF-1, SF-2 are determined as follows. FE-SEM(S-800) available from Hitachi Seisakusho, Kabushiki Kaisha, Japan is used, and one hundred samples of toner images are randomly taken, and the images are analyzed by an image analyzing apparatus (Luzex3) available from Nikore through an interface, and the following equations are used.

$$SF\text{-}1=(MXLNG)^2/\mathrm{AREA}\times\pi/4\times100$$

$$SF\text{-}2=(PERI)^2/\mathrm{AREA}\times\pi/4\times100$$

(AREA: toner projected area, MXLNG: absolute maximum length per 1 circumferential length)

The shape factor SF-1 indicates a sphericality, and non-sphericality increases with increase of the value over 100. SF-2 indicates unsmoothness degree, and the unsmoothness of the surface of the toner increases with increase of the value over 100.

The toner manufacturing method may be a so-called pulverization method (if the shape factor is within the range), a suspension polymerization method disclosed in Japanese Laid-open Patent Application No. SHO-36-102231 or Japanese Laid-open Patent Application No. SHO-59-53856 wherein toner is directly produced, a dispersion polymerization method wherein the toner is directly produced using water base organic solvent in which polymer is non-soluble and monomer is soluble, or an emulsion polymerization method such as a soap free polymerization method wherein toner is directly produced by polymerization under the presence of water-soluble property polymerization initiator.

In this embodiment, the use is made with the suspension polymerization method under the normal pressure or pressurization since it can relatively easily produce fine particle toner which has a particle size of 4–8 $\mu$m with sharp grain size distribution, and since it can easily control the shape factor SF-1 of the toner to 100–180 and SF-2 to 100–140. The monomer is a suspended coloring particle having a weight average particle size of 7 $\mu$m and comprised of styrene resin material, n-butylacrylate, salicylate metal chemical compound as an electrification control material, saturated polyester as polarity range, coloring material.

To the material, 1.5 wt. % of hydrophobic silica is externally added, so that negative toner 8 which is good in transfer property and which is less worn during the cleaning of the photosensitive drum 1, as described hereinbefore, is produced.

In such a developing device 4, as shown in FIG. 2, the toner 8 in the developing container 14 is fed toward the elastic roller 6 with the rotation of the stirring member 16 in the direction indicated by arrow C.

The toner 8 is carried to the neighborhood of the developing sleeve 5 with the rotation of the elastic roller 6 in direction indicated by arrow D, but the toner 8 carrying on the elastic roller 6 is subjected to the triboelectric charge by the rubbing with the developing sleeve 5 at the contact portion between the developing sleeve 5 and the elastic roller 6, and is deposited on the developing sleeve 5.

Then, the toner 8 is fed and is subjected to the press-contact of the elastic blade 7 with the rotation of the developing sleeve 5 in the direction indicated by arrow B, where it acquires a proper triboelectric charge amount, and is formed into a thin layer formation on the developing sleeve 5. In this embodiment, the settings are made to provide the proper charge amount of −60–−20 $\mu$C/g, and the proper toner coating amount of 0.4–1.0 mg/$cm^2$ with the toner layer thickness of 10–20 $\mu$m.

However, when the development is repeated under high temperature and high humidity ambience, the charge amount of the toner 8 lowers.

Therefore, in this embodiment, in order to prevent the decrease of the charge amount of the toner 8, a toner charging roller 20 (press-contact elastic member) is press-contacted to the entire area of the developer layer formed on the developing sleeve 5, and the charging is effected using discharge. The toner charging roller 20 is a rubber roller of NBR, and is mounted to an urging member 21. The contact force of the toner charging roller 20 to the developing sleeve by the urging member 21 is 100–200 gF. By the contact of the toner charging roller 20, the developer layer on the developing sleeve 5 is densely filled and is uniformly coated. The longitudinal positional relation between the elastic blade 7 and the toner charging roller 20, as shown in FIG. 3, is preferably such that toner charging roller 20 can assuredly cover the entire contact area of the developing sleeve 5 with the elastic blade 7.

In this embodiment, the toner 8 is regulated by the elastic blade 7, and thereafter, the toner 8 is charged by the toner charging roller 20, but it is a possible alternative for the toner charging roller 20 to function also as the elastic blade 7.

Figure 4:
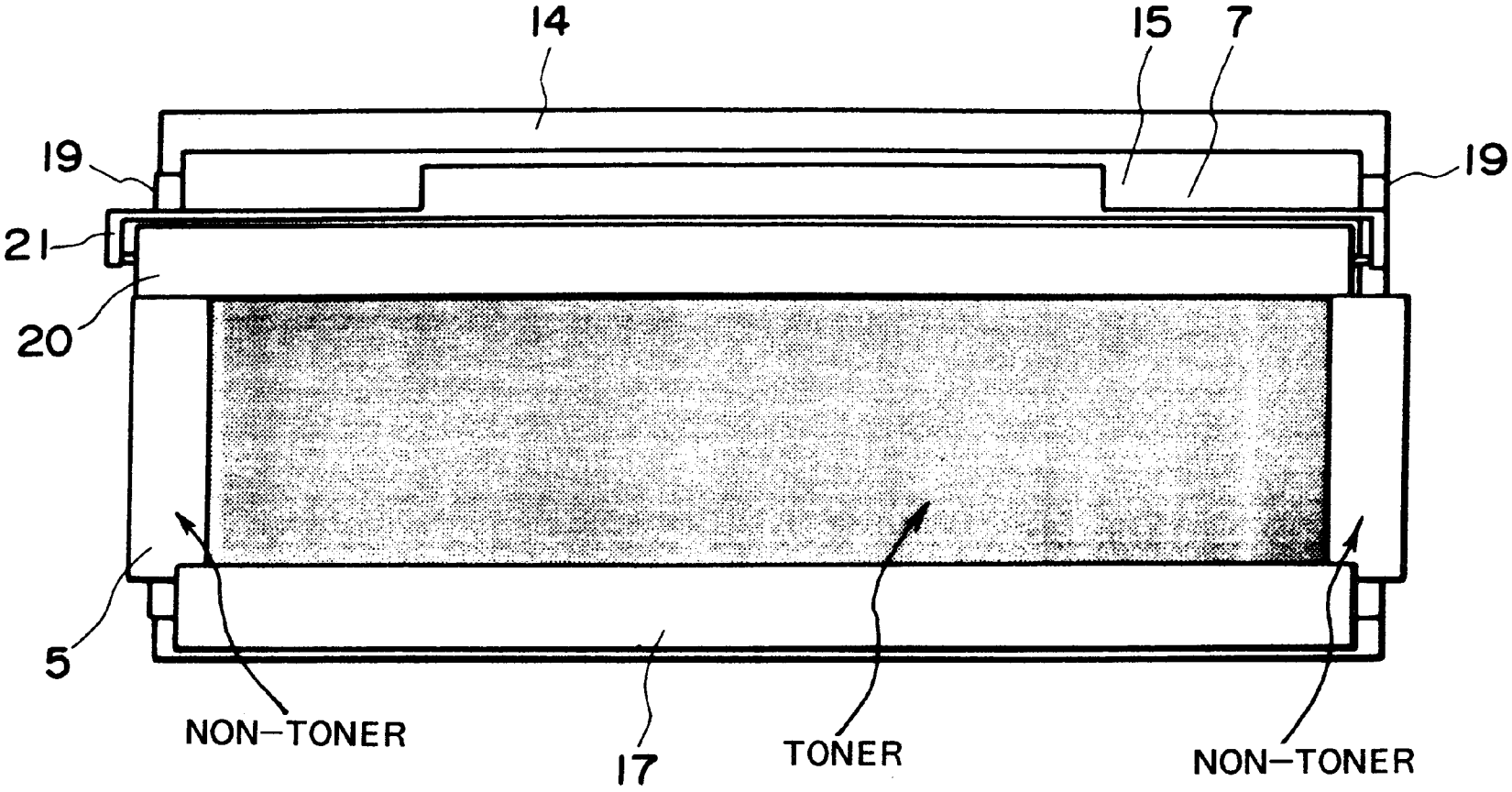
FIG. 4 is a view of the developing device as seen from the photosensitive member, wherein the developing sleeve is also shown.

The longitudinal positional relation of the toner charging roller 20 on the developing sleeve 5, as shown in FIG. 4, is such that it is contacted to both of the non-toner coated portion and toner coating portion on the developing sleeve 5. The toner charging roller 20 makes slipping action if the contact is only at the toner coating portion, since the flowability of the toner is high, and therefore, toner charging roller 20 is not stably driven. To solve the problem, toner charging roller 20 is contacted to the non-coated portion.

The toner charging roller 20 is preferably driven by the developing sleeve 5 or is driven otherwise at the same peripheral speed. If there is a peripheral speed difference between the developing sleeve 5 and the toner charging roller 20, the toner coating is non-uniform with the result that toner is transferred onto the photosensitive member 1 in the background areas (fog), or the scattering or leakage of the toner may occur during the development.

Figure 5:
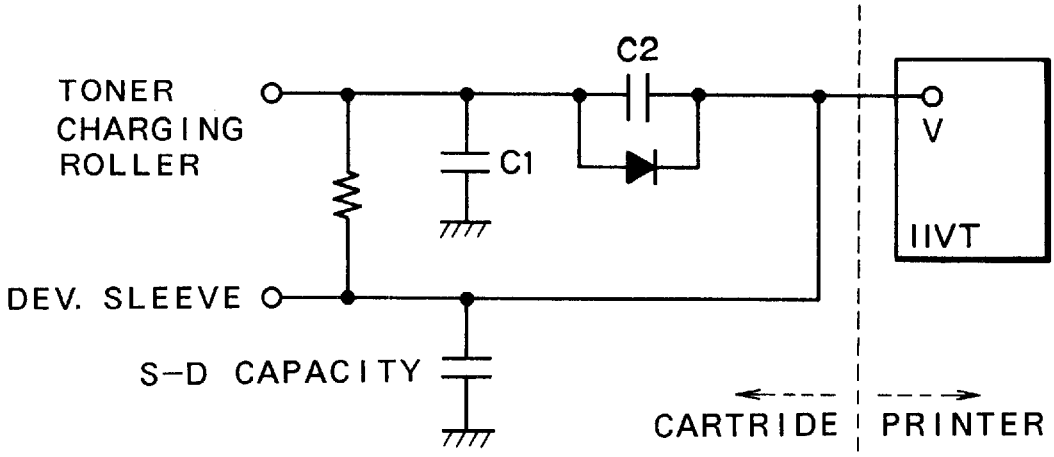
FIG. 5 is an equivalent circuit of the developing device of Embodiment 1.

The bias voltage to the toner charging roller 20 is applied from a branch of a DC biased AC voltage (development AC voltage) applied between the developing sleeve 5 and the photosensitive drum 1 from the voltage source 18 (FIG. 2), as shown in FIG. 5 as an equivalent circuit.

Figure 6:
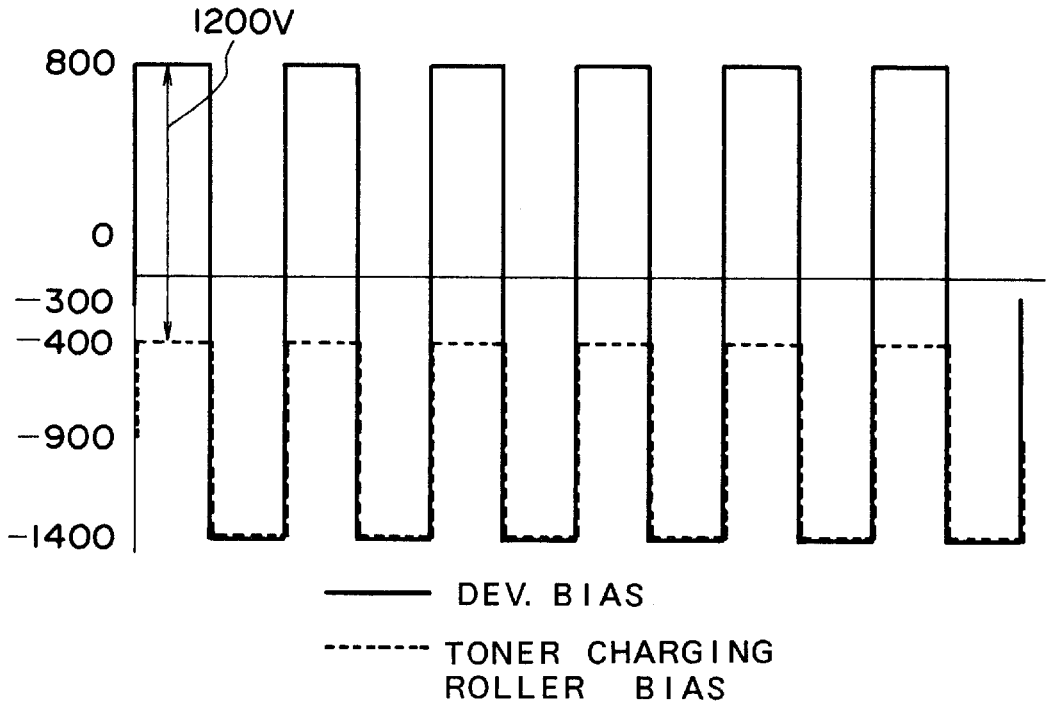
FIG. 6 is a bias voltage waveform graph used in Embodiment 1.

The waveform of the bias voltage applied between the developing sleeve 5 and the toner charging roller 20 is as shown in FIG. 6, and the capacities of the capacitors C1, C2 in FIG. 5 are adjusted to provide the potential difference between the developing sleeve 5 and the toner charging roller 20 during the toner back-transfer bias voltage application. In this manner, the toner 8 is electrically charged by the toner charging roller 20 on the developing sleeve 5. The charge is applied using electric discharge.

The bias voltage applied to the developing sleeve 5 in this embodiment is a superimposed voltage of a DC voltage of Vdc=−300V and an AC voltage of rectangular wave having a Vpp=2200V and f=2200 Hz. The bias voltage applied to the toner charging roller 20 is a superimposed voltage of a Vdc=−900V and an AC voltage of rectangular wave having a Vpp=1000V and f=2200 Hz. There is not phase difference between the bias voltage applied to the developing sleeve 5 and the bias voltage applied to the toner charging roller 20.

The description will be made as to a charging method using the toner charging roller 20.

Figure 7:
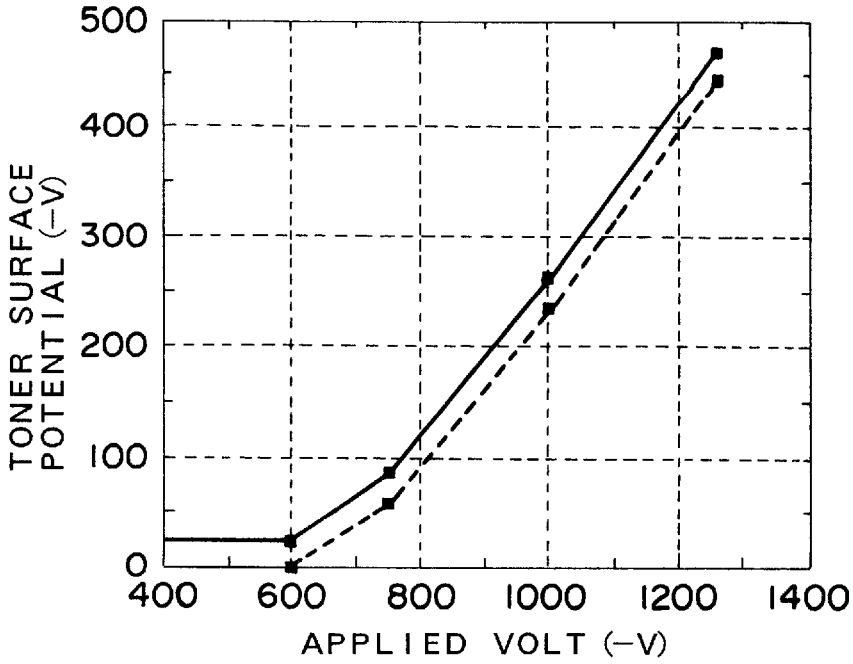
FIG. 7 is a graph showing a toner discharge property of a roller ($10^6\Omega$).

As shown in FIG. 7, when the resistance of the toner charging roller 20 is $10^6\Omega$, the surface potential of the toner is as shown by a solid line. The surface potential of the toner is −20V when the applied voltage is 0V. This is because the toner has been subjected to the triboelectric charge by the elastic blade 7. Excluding the surface potential due to the triboelectric charge, the discharge start voltage relative to the toner, as shown in FIG. 7 by broken line, rises with inclination 1 from the −600V, and rises similarly to the DC discharge type charging relative to the photosensitive drum.

The discharge start voltage between the toner charging roller 20 and the toner 8 is determined as an intersection between the following equations (1) and (2).

$$Vb=312+6.2\ g \quad (1)$$

$$Vg=g(Va-Vc)/((Lt/Kt)+g) \quad (2)$$

Where g: gap width,

Vb: approximated equation of Paschen law when g>8 $\mu$m,

Vg: a voltage across the gap between the toner charging roller and the surface of the toner layer, Va: a voltage applied to the toner charging roller, Vb: a surface potential of a toner layer, Lt: a toner layer thickness, and Kt: a dielectric constant of the toner layer.

The toner 8 used in this embodiment has a good particle size distribution and a spherical configuration, and therefore, the ratio between the toner and the air in the toner layer is constant, and Kt in the equation (2) (dielectric constant of the toner layer) is stable, so that charging action is a performed with stabilized discharge.

As another charging method for the toner, there is an injection charging.

Figure 8:
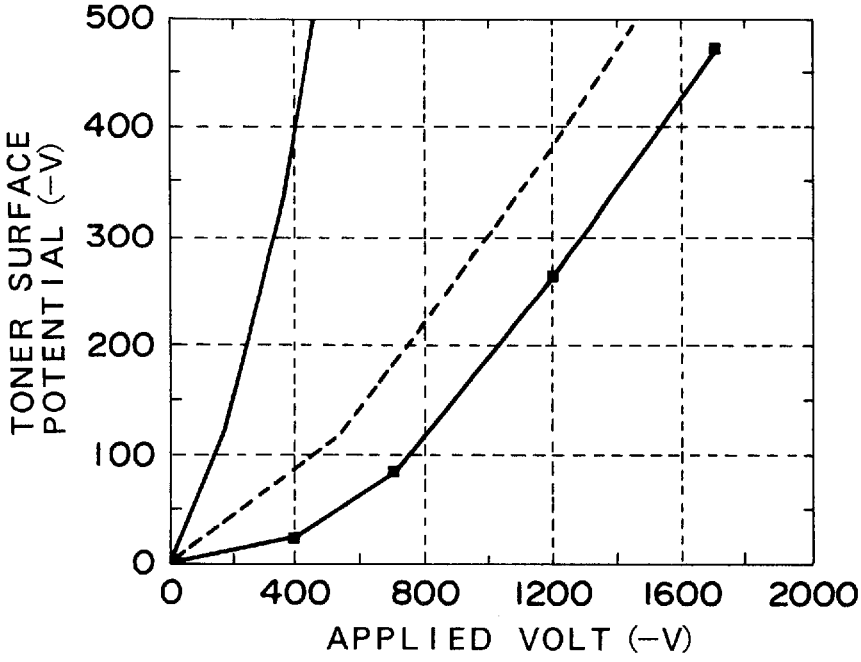
FIG. 8 is a graph showing a toner charging property in the case of using injection charging.

In such a case, the voltage applied to the toner charging roller and the surface potential of the toner area as shown in FIG. 8. In FIG. 8, the solid line (thick) indicates an ideal injection charging, wherein the voltage rises with inclination 1 from the applied voltage of 0V. The inclination does not exceed 1 in the injection charging. The solid line (thin) and broken line show the case where the injection charging property is deteriorated.

From the foregoing, the charging method in this embodiment is considered as using electric discharge.

The experiment results are those when the entire longitudinal area of the toner charging roller 20 is contacted to the toner coated portion, but actually, it is contacted to both of the toner coating portion and the non-toner coated portion, and therefore, when the resistance of the toner charging roller 20 is $10^6\Omega$, the current flows thereinto from the non-toner coated portion, with the result that voltage between the toner charging roller 20 and the toner coated portion does not satisfy the discharge start voltage. The investigations have been made as to the resistance range within which the toner discharge is possible. As shown in Table 1, when it is not more than $10^7\Omega$, there is no voltage between the toner charging roller 20 and the toner coating portion with which the toner discharge is possible; and when it is not less than $10^{12}\Omega$, the discharge start voltage is too large in the structure such as the embodiment wherein the bias for the toner charging roller 20 is obtained from the developing bias. Therefore, the range of the resistance of the toner charging roller 20 is preferably $10^8$–$10^{11}\Omega$. However, the lower limit value of the proper range of the resistance of the toner charging roller 20 is expanded when the toner charging roller 20 is provided with a dielectric layer at the non-toner coated portion or when the entirety resistance of the developing sleeve is high.

TABLE 1

| Roller resistance (Ω) | Toner dischargeability |
|---|---|
| $10^5$ | no |
| $10^6$ | no |
| $10^7$ | no |
| $10^8$ | yes |
| $10^9$ | yes |
| $10^{10}$ | yes |
| $10^{11}$ | yes |
| $10^{12}$ | no |

Figure 9:
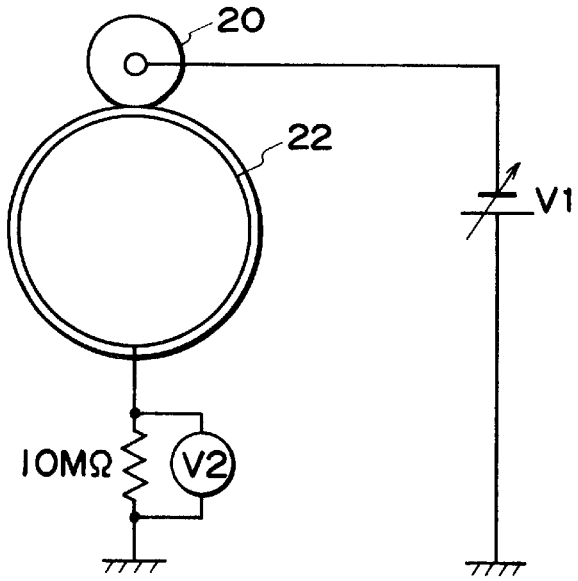
FIG. 9 is a schematic view illustrating a roller resistance measuring method.

The measuring method of the resistance is as follows: As shown in FIG. 9, an aluminum roller 22 having a diameter of 16 mm is contacted to a toner charging roller 20 with a contact force 170 gf, and the aluminum roller 22 is rotated at 2 rps. Then, toner charging roller 20 is supplied with a DC voltage of V1=400V. A resistance of 10 MΩ is disposed at a ground side, and the voltage V2 between the opposite ends is measured, and the current is calculated. Then, the resistance of the toner charging roller 20 is calculated.

Figure 10:
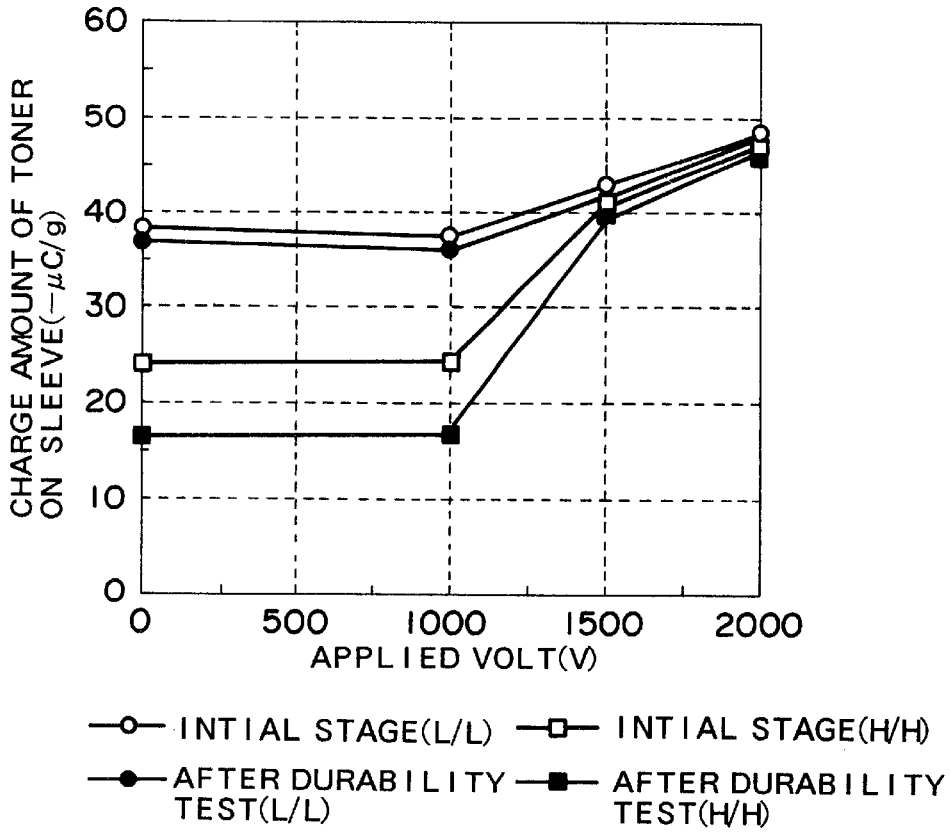
FIG. 10 is a graph showing a relation between a toner charging roller and an amount of toner charge on a developing sleeve in Embodiment 1.

The discharge start voltage between the toner charging roller 20 and the toner having a lowered charge amount in the toner 8 on the developing sleeve 5, is not less than 1200V. Therefore, the capacities of the capacitors C1 and C2 in FIG. 5 are adjusted so that potential difference between the toner charging roller 20 and the developing sleeve 5 when the toner back-transfer bias voltage is applied is not less than 1200V and so that charge amount of the toner 8 after the discharge is the same as that under the low temperature and low humidity ambience (the ambience in which the charge amount of the toner is highest). In this embodiment, as shown in FIG. 10, the toner voltage applied to the charging roller is 1500V with which there is no FIG. 10 in the toner charge amount in the ambience and durability test. Even when the toner charging roller 20 is supplied with the voltage under the low temperature and low humidity ambience with this condition, the discharge start voltage is not reached so that discharge does not occur, since the surface potential of the toner layer is high. Therefore, the charge amounts of the toner 8 under the high temperature and high humidity condition and low temperature and low humidity condition, are substantially the same.

After the thin toner layer receives the charge by the toner charging roller 20, it is fed to a developing zone where it is faced to the photosensitive drum 1. In the developing zone, the thin toner layer on the developing sleeve 5, as shown in FIG. 2, is transferred to the electrostatic latent image on the photosensitive drum 1 by the AC voltage (development AC bias) biased with a DC applied between the developing sleeve 5 and the photosensitive drum 1 from the voltage source 18.

The undeveloped toner not consumed in the developing zone is collected by the lower portion of the developing sleeve 5 by the rotation of the developing sleeve 5. In the collection portion, there is provided a seal member 17 of a flexible sheet which permits passing of the unused toner into the developing container 14 but prevents passing of the toner 8 at the lower portion of the developing sleeve 5.

The undeveloped toner thus collected is removed from the surface of the developing sleeve 5 at the contact portion between the elastic roller 6 and the developing sleeve 5. Most of the thus removed toner is fed with the rotation of the elastic roller 6 and is mixed with the toner 8 in the developing container 14, so that charge of the toner 8 is dispersed. Simultaneously, by the rotation of the elastic roller 6, fresh toner is supplied onto the developing sleeve 5, and the operation is repeated.

As described in the foregoing, by the provision of the toner charging roller 20, the toner is electrically charged by the toner charging roller after the toner 8 passes by the elastic blade 7, so that charge amount of the toner 8 is maintained high. Thus, a high charge amount which is uniform in the longitudinal direction of the developing sleeve can be maintained, and therefore, a developing device which is substantially immune to the ambient condition variation can be provided, and the thin toner layer can be stably formed on the developing sleeve.

In this embodiment, the present invention is used with a developing unit which is detachably mountable to a main assembly of an image forming apparatus, but is applicable to a developing device fixed in the image forming apparatus and having a structure supplying only the toner. The present invention may be used with a process cartridge which is detachably mountable relative to a main assembly of an image forming apparatus and which contains as a unit a developing device and at least one of a photosensitive drum, a cleaning blade, a residual toner accommodating container and a charging device.

<Embodiment 2>

Figure 11:
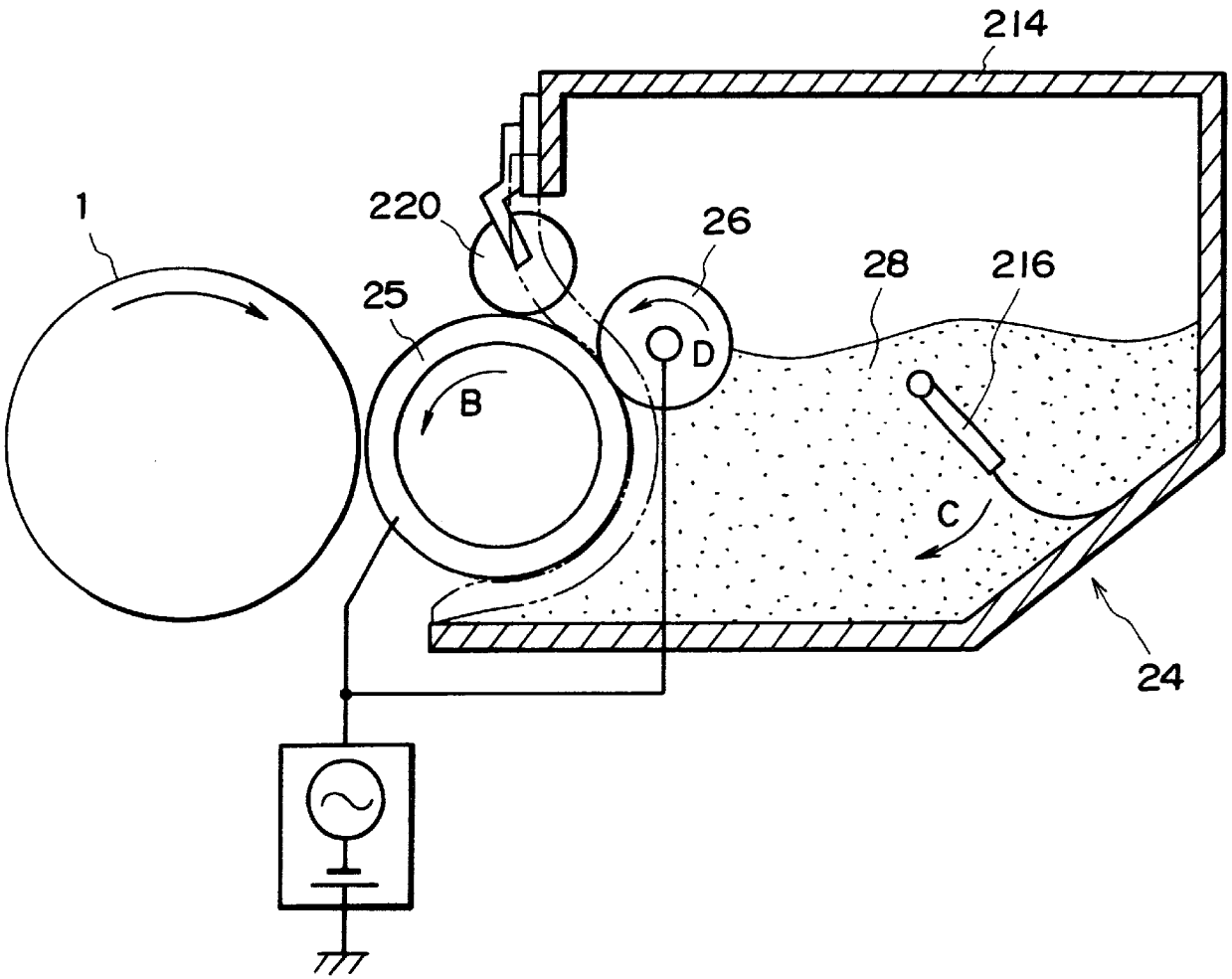
FIG. 11 is a schematic illustration showing a developing device according to Embodiment 2.
Figure 12:
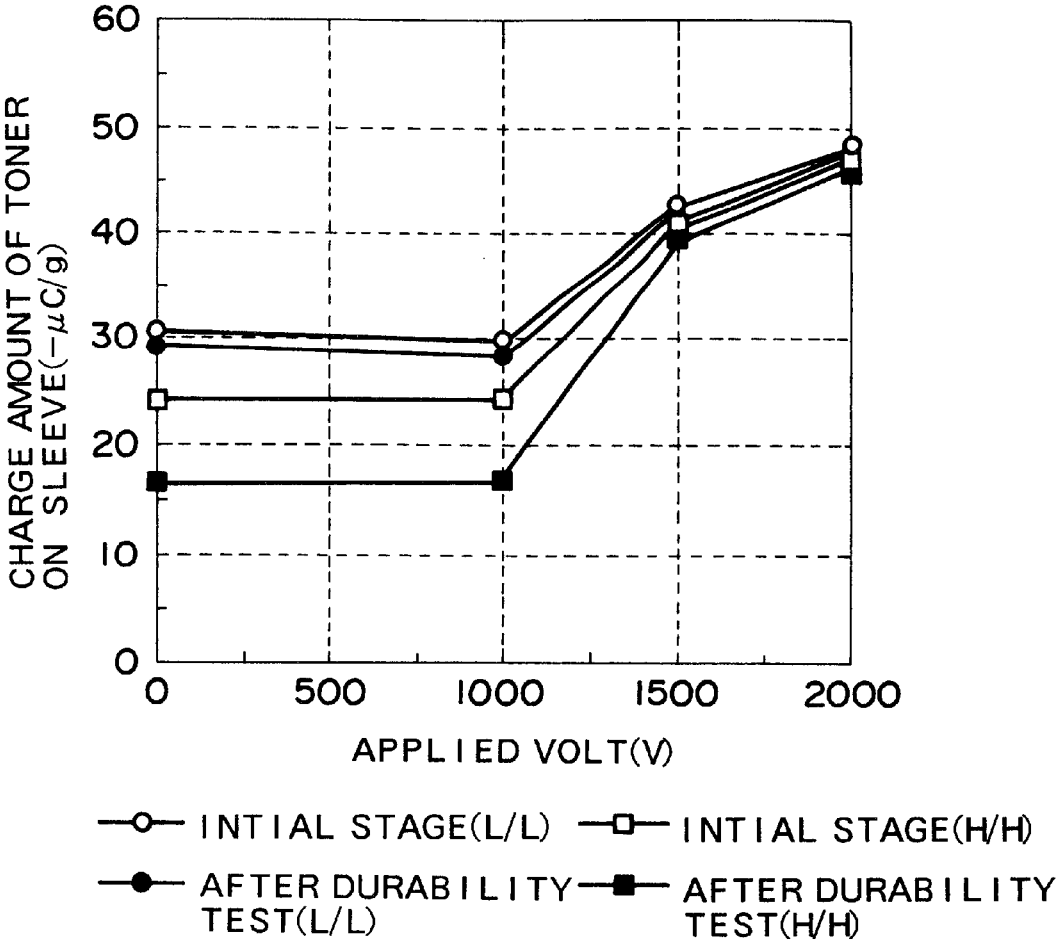
FIG. 12 is a graph showing a relation between a toner charging roller and an amount of toner charge on a developing sleeve in Embodiment 2.

Referring to FIGS. 11 and 12, the description will be made as to Embodiment 2 of the present invention.

As shown in FIG. 11, the developing device 24 of this embodiment does not use an elastic blade 7 (regulating member in Embodiment 1). It is in the form of a developing unit detachably mountable relative to a main assembly of an image forming apparatus shown in FIG. 1, similarly to Embodiment 1.

In the developing device 24, the toner 28 in the developing container 214 is fed toward the elastic roller 26 with the rotation of the stirring member 216 in the direction indicated by an arrow C, during the developing operation.

By the rotation of the elastic roller 26 in the direction indicated by an arrow D, the toner 28 is fed to the neighborhood of the developing sleeve 25.

The toner 28 carried on the elastic roller 26 is slightly charged by triboelectricity by being rubbed with the developing sleeve 25 at the contact portion between the developing sleeve 25 and the elastic roller 26, and is formed into a thin layer on the developing sleeve 25. In this embodiment, the settings are selected so that the toner coating amount is 0.4–1.0 mg/cm$^2$, the toner layer thickness is 10–20 $\mu$m, and the charge amount is −20—10 $\mu$C/g.

Thereafter, with the rotation of the developing sleeve 25 in the direction indicated by an arrow B, it is fed to the contact portion between the toner charging roller 220 and the developing sleeve 25.

In order to maintain high charge amount of the toner 28 which is uniform, the toner charging roller 220 is contacted to the entire area of the developer layer formed on the developing sleeve 25, and it is charged by charging using discharge.

When the voltage between the toner charging roller 220 and the toner 28 on the developing sleeve 25, is 1500V as shown in FIG. 12, then there is not difference in the amount of the toner charge under the ambience and through the durable test. Therefore, the potential difference between the developing sleeve 25 and the toner charging roller 220 during the toner back-transfer bias voltage application, is set to 1500V by the adjustment of the capacities of the capacitors C1, C2 in FIG. 5. Thereafter, the thin toner layer on the developing sleeve 25 is fed uniformly to the developing zone Where it is faced to the photosensitive drum 1.

As described in the foregoing, by the provision of the toner charging roller 220, the toner 28 is charged by the toner charging roller 220 after it passes by the elastic roller 26, so that the charge amount of the charge can be maintained high. Thus, a high charge amount which is uniform in the longitudinal direction of the developing sleeve can be maintained, and therefore, a developing device which is substantially immune to the ambient condition variation can be provided, and the thin toner layer can be stably formed on the developing sleeve.

In this embodiment, the present invention is used with a developing unit including a developing device which is detachably mountable to a main assembly of an image forming apparatus.

However, the present invention is applicable to a developing device which is fixed in a main assembly of an image forming apparatus and which is supplied with toner. The present invention may be used with a process cartridge which is detachably mountable relative to a main assembly of an image forming apparatus and which contains as a unit a developing device and at least one of a photosensitive drum, a cleaning blade, a residual toner accommodating container and a charging device.

<Embodiment 3>

Figure 13:
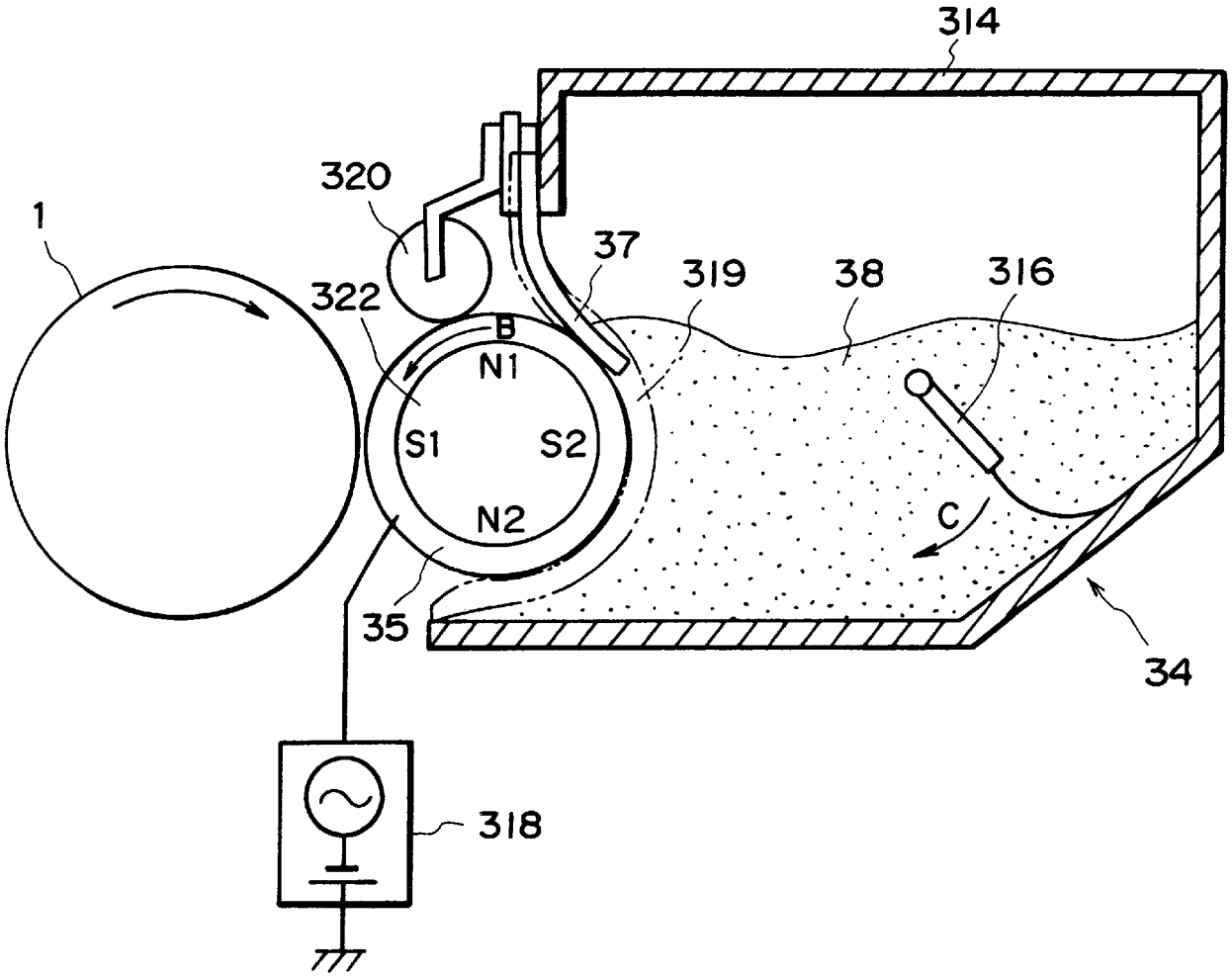
FIG. 13 is a schematic illustration showing a developing device according to Embodiment 3.
Figure 14:
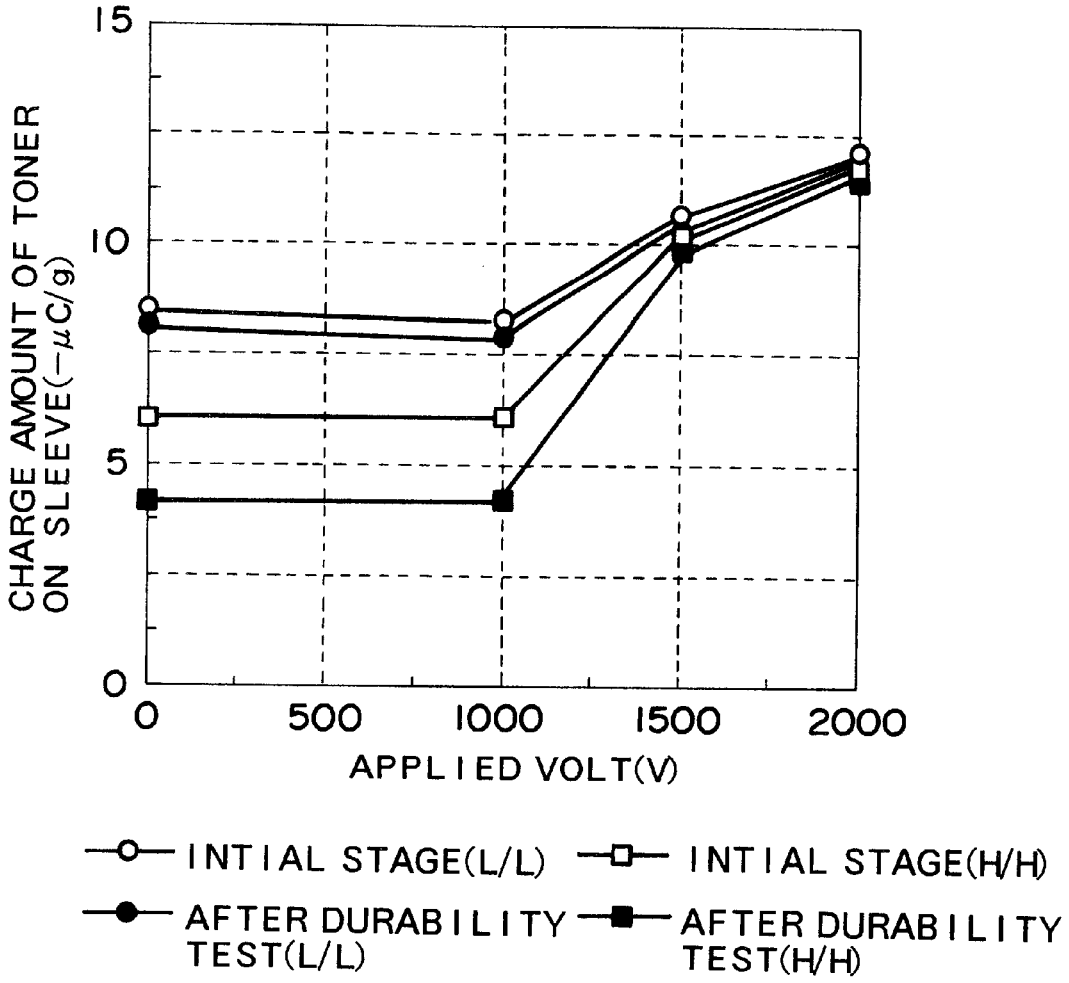
FIG. 14 is a graph showing a relation between a toner charging roller and an amount of toner charge on a developing sleeve in Embodiment 3.
Figure 15:
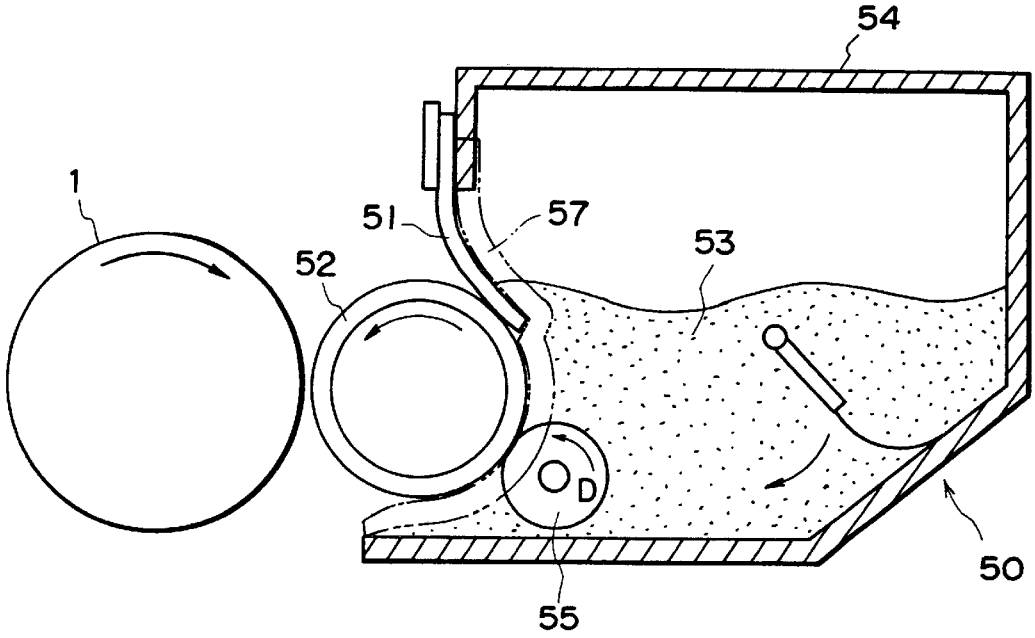
FIG. 15 is a schematic illustration showing a developing apparatus using one-component non-magnetic toner.
Figure 16:
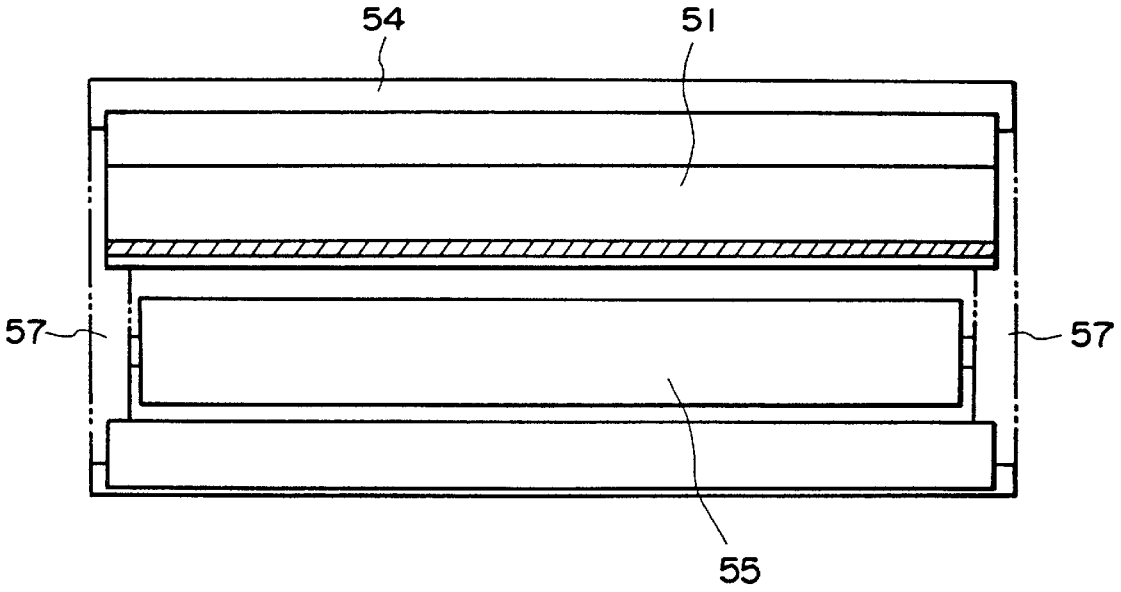
FIG. 16 is a view of the developing device of FIG. 15 as seen from a photosensitive member.
Figure 17:
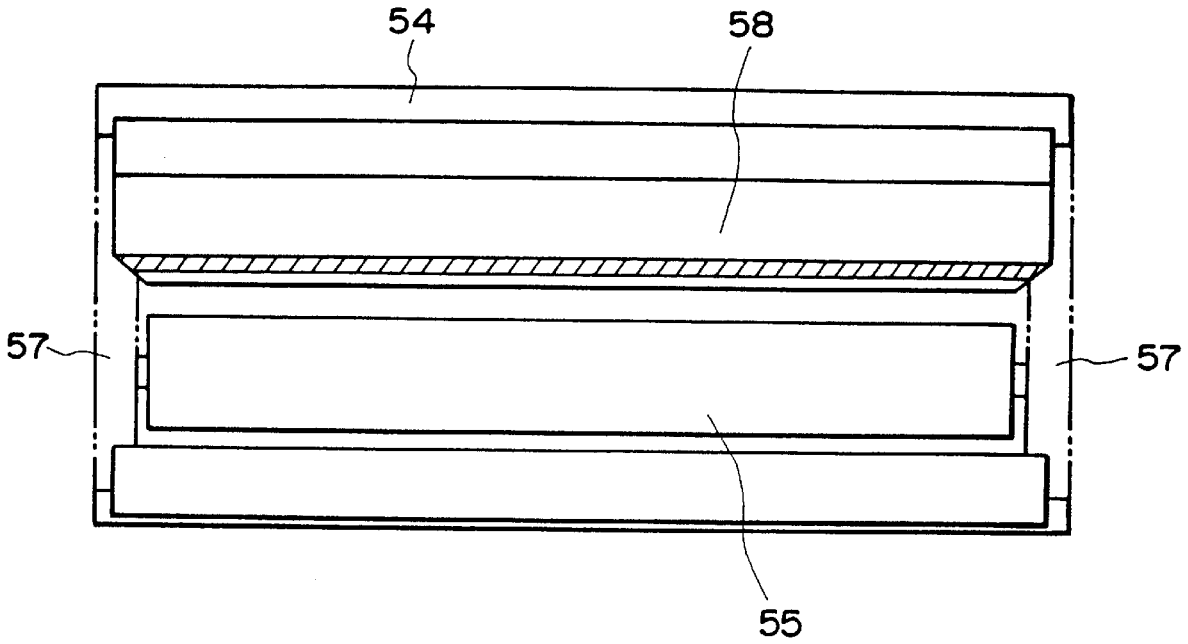
FIG. 17 is a view of a developing device according to another embodiment, as seen from a photosensitive member.

Referring to FIGS. 13 and 14, Embodiment 3 will be described. This embodiment is similar to Embodiment 1, but a magnetic one component developer is used. The developing device 34 will be described referring to FIG. 13.

The developing device 34 of this embodiment comprises a developing container 314 accommodating insulative magnetic toner 38 (one component developer) and a developing sleeve 35 positioned in an opening extended in the longitudinal direction of the developing container 314 and disposed opposed to the photosensitive drum 1, and it develops the electrostatic latent image on the photosensitive drum 1 into a visualized image.

Substantially a half (right) of the developing sleeve 35 is in the developing container 314, and substantially a half (left) thereof is exposed to the outside of the developing container 314. The exposed surface is opposed to the photosensitive drum 1 with a small gap.

The developing sleeve 35 is rotated in the direction indicated by an arrow B, and it contains a magnet roller 322 having four magnetic poles N1, N2, S1, S2. Similarly to Embodiment 1, an elastic blade 37 and a toner charging roller 320 are contacted to the peripheral surface of the developing sleeve 35, and end seal members 319 are disposed at the opposite longitudinal end portions of the developing sleeve 35, similarly to Embodiment 1.

In FIG. 1, the photosensitive drum 1 is uniformly charged to Vd=−600V by a charging device 2. Then, the photosensitive member is exposed to a laser beam 3 in accordance with an image signal so that the potential of the image portion potential (exposed portion) becomes V1=−100V, by which an electrostatic latent image having an image portion for receiving the toner (exposed portion) is formed. The electrostatic latent image formed on the photosensitive drum 1 is developed by a developing device 34 shown in FIG. 13.

The toner 38 used in this embodiment is different from the nonmagnetic one component toner used with Embodiments 1 and 2, and is negative charging magnetic one component toner. Binder resin of styrene copolymer resin material 100 parts by weight, magnetic member particle 100 parts by weight, negative electrification control material 2 parts, wax 3 parts, are melted and kneaded by a biaxial extruder, and then cooled. The product is roughly pulverized by a hammer mill, and the pulverized particles are classified. Then, they are made spherical through a hybridization method. The average particle size is 5.0 μm (classification powder). The classified product having the average particle size of 5.0 μm is added with 1.0 parts by weight of hydrophobic silica fine particle, thus providing the developer. The toner 38 used in this embodiment has a weight average particle size of 3.5–7.0 μm, and the resistance and the configuration are similar to those used in Embodiment 1.

The toner 38 in the developing container 314 is fed to the neighborhood of the developing sleeve 35 by a stirring member 316, and is supplied to the developing sleeve 35 by the magnetic field function provided by the magnet roller 322, and is fed with the rotation of the developing sleeve 35. Thereafter, it is subjected to the triboelectric charge application and the layer thickness regulation by the contact portion with the elastic blade 37, and is fed to the developing zone. The amount of the coated toner on the sleeve is 0.8–2.0 $mg/cm^2$ (10–20 μm in toner layer thickness), and the charge amount of the toner is −5−−10 μC/g.

The developing sleeve 35 is a non magnetic aluminum sleeve having a diameter of 16.0 mm, and the surface thereof is coated with a resin material layer containing electroconductive particles (surface roughness is Ra=1.0 μm). The developing sleeve 35 is rotated at a peripheral speed which is 100–140% the peripheral speed of the drum.

A magnet roller 322 is fixed in the developing sleeve 35. One magnetic pole S1 of the magnet roller 322 is disposed faced to the photosensitive member 1, and the magnetic pole S1 provides a peak magnetic flux density of 750–950 G in the radial direction on the surface of the sleeve. In the developing zone, chains of toner are formed, and fog toner is transferred back to the sleeve.

The developing sleeve 35 is supplied, from a voltage source 318, with an alternating voltage biased with a DC to form a developing electric field between itself and the photosensitive member 1, and the electrostatic latent image is developed by the electric field. The voltage applied to the developing sleeve 35 is a DC voltage Vdc=−500V biased with an AC in the form of a rectangular wave having Vpp=1600V, f=1800 Hz (developing bias 318). The gap is 300 μm at the closest position between the developing sleeve 35 and the photosensitive member 1, and reverse development is carried out.

However, the amount of the charge of the toner 38 decreases when the developing operation is repeated under the high temperature and high humidity ambiences.

In order to prevent decrease of the charge amount of the toner 38, a toner charging roller 320 is contacted to the entire area of the developer layer formed on the developing sleeve 35, and the charging is carried out using the discharge.

When the voltage between the toner charging roller 320 and the toner 38 on the developing sleeve 35, is 1500V as shown in FIG. 14, then there is not difference in the amount of the toner charge under the ambience and through the durable test. Therefore, the potential difference between the developing sleeve 35 and the toner charging roller 320 during the toner back-transfer bias voltage application, is set to 1500V by the adjustment of the capacities of the capacitors C1, C2 in FIG. 5.

Thereafter, the thin toner layer on the developing sleeve 35 is fed uniformly to the developing zone where it is faced to the photosensitive drum 1.

As described in the foregoing, by the provision of the toner charging roller 320, the toner 38 is charged by the toner charging roller 320 after it passes by the elastic blade 37, and the charge amount of the charge can be maintained high. Thus, a high charge amount which is uniform in the longitudinal direction of the developing sleeve can be maintained, and therefore, a developing device which is substantially immune to the ambient condition variation can be provided, and the thin toner layer can be stably formed on the developing sleeve.

A further embodiment of the present invention will be described.

In the above-described embodiments, the toner charging roller is provided extended over the entire longitudinal area of the developing sleeve. If the charge of the developer at the ends are desired to be increased, the charge of the developer in the image region is also increased.

The developer in the non-image area desirably has a large mirror force since then the leakage of the developer can be effectively prevented, but if the mirror force of the developer in the image region is too large, the developer is unable to depart from the developing sleeve with the result of low density images.

In the following embodiment, the charge of the developer is increased at the ends of the developing sleeve rather than in the image region.

<Embodiment 4>

The structures and therefore the sectional view of the developing device are the same as in FIGS. 1, 2, and therefore, the detailed description thereof is omitted for simplicity.

Figure 18:
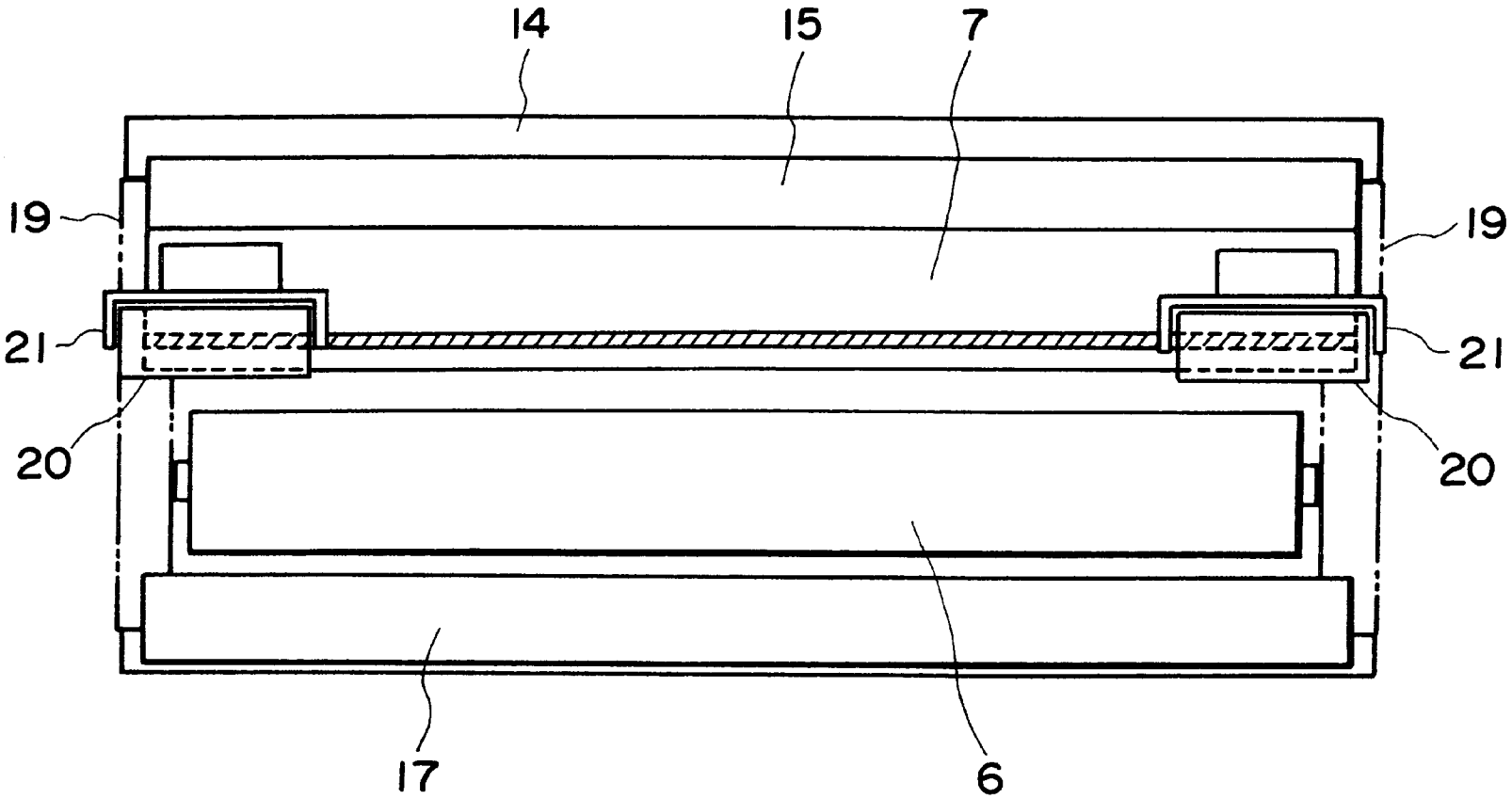
FIG. 18 shows a developing device according to Embodiment 4, as seen from the photosensitive member, wherein the developing sleeve is omitted for better understanding.

FIG. 18 is a view of the developing device as seen from the photosensitive member 1, wherein developing sleeve 5 is omitted for better understanding.

In FIG. 18, a contact nip between the elastic blade 7 and the developing sleeve 5 is indicated by hatched portions. In order to assure the sealing property of the elastic blade 7, it is necessary to press-contact the end seal member 19 to the developing sleeve 5 with a quite high pressure to assure the sealing property, with the result that elastic blade 7 nipped between the developing sleeve 5 and the end seal member is deformed as if it follows the peripheral surface of the developing sleeve 5 from the nip of the developing sleeve 5 at the opposite ends to the edge portion. As a result, the longitudinally inside end portion of the elastic blade 7 tends to separate, and therefore, the developer layer formed on the developing sleeve 5 at these portions are thicker than the other portion, and the charging of the toner 8 may become low.

The toner 8 is the same as the one used in Embodiment 1.

The toner charging roller 20 (press-contact elastic member) functions to charge (using discharge) the portion where the charge of the toner 8 is low for the reason described above. The toner charging roller 20 is a rubber roller of NBR, and is mounted to the urging member 21. The contact force of the toner charging roller 20 to the developing sleeve 5 by the urging member 21 is 100–200 gF. By the contact of the toner charging roller 20, the developer layer on the developing sleeve 5 is densely filled and is uniformly coated. The longitudinal positional relation between the elastic blade 7 and the toner charging roller 20, as shown in FIG. 3, is preferably such that toner charging roller 20 can assuredly cover the entire contact area of the developing sleeve 5 with the elastic blade 7.

Figure 19:
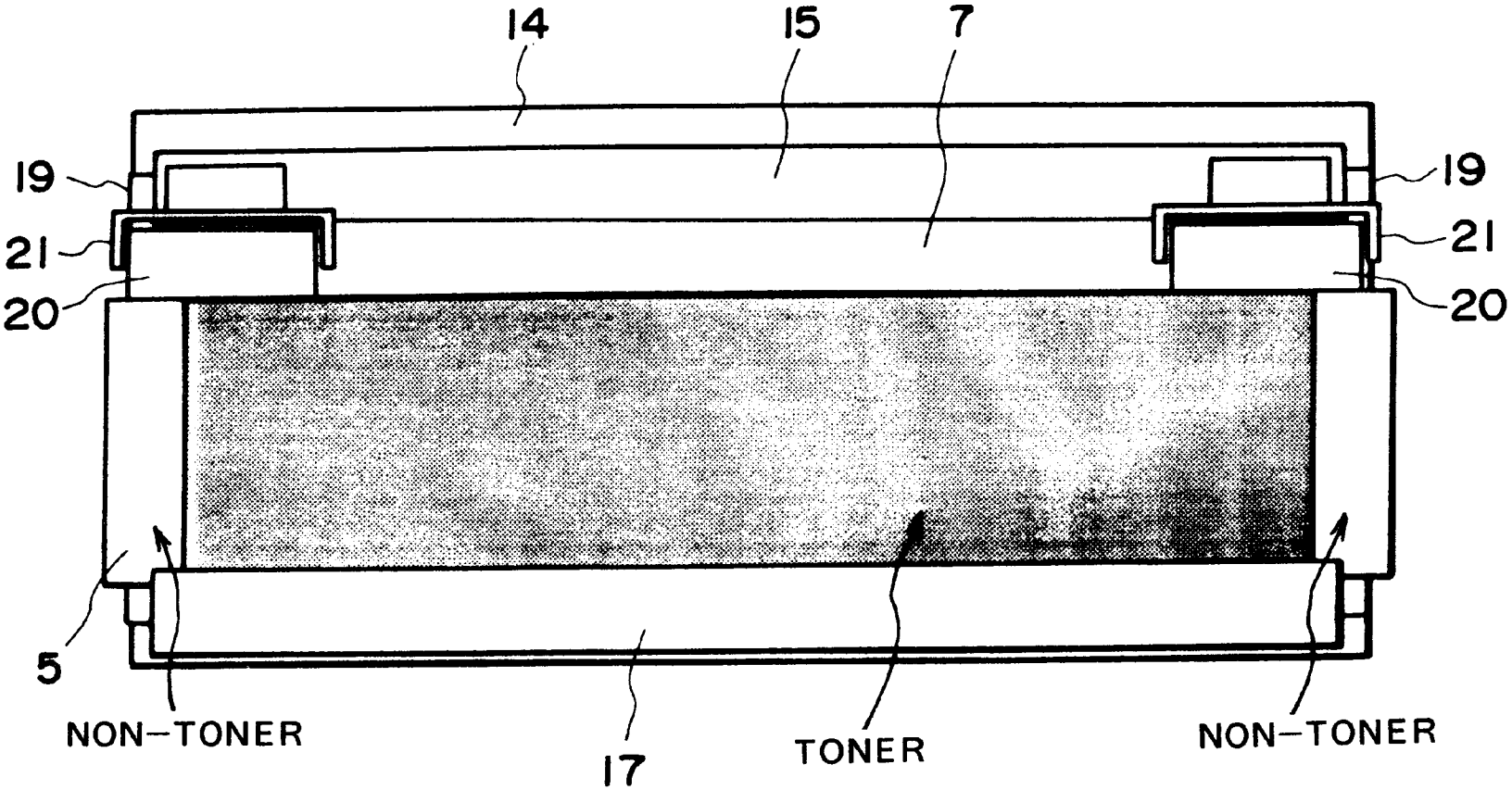
FIG. 19 shows a developing device of Embodiment 4 as seen from the photosensitive member, wherein the developing sleeve is shown.

The longitudinal positional relation of the toner charging roller 20 on the developing sleeve 5, as shown in FIG. 19, is such that it is contacted to both of the non-toner coated portion and toner coating portion on the developing sleeve 5. The toner charging roller 20 makes slipping action if the contact is only at the toner coating portion, since the flowability of the toner is high, and therefore, it is not stably driven. To solve the problem, it is contacted to the non-coated portion.

The contact region of the toner charging roller 20 is a non-image area, and the toner in the image region is not charged.

The toner charging roller 20 is preferably driven by the developing sleeve or is driven at the same peripheral speed.

The bias voltage applied to the toner charging roller 20 and the voltage source for applying the bias voltage are the same as in Embodiment 1.

By the charging of the toner at the end of the non-image region on the developing sleeve, the mirror force of the toner at the end is increased, so that high sealing effect is provided at the ends, thus preventing toner scattering and leakage.

<Embodiment 5>

Figure 20:
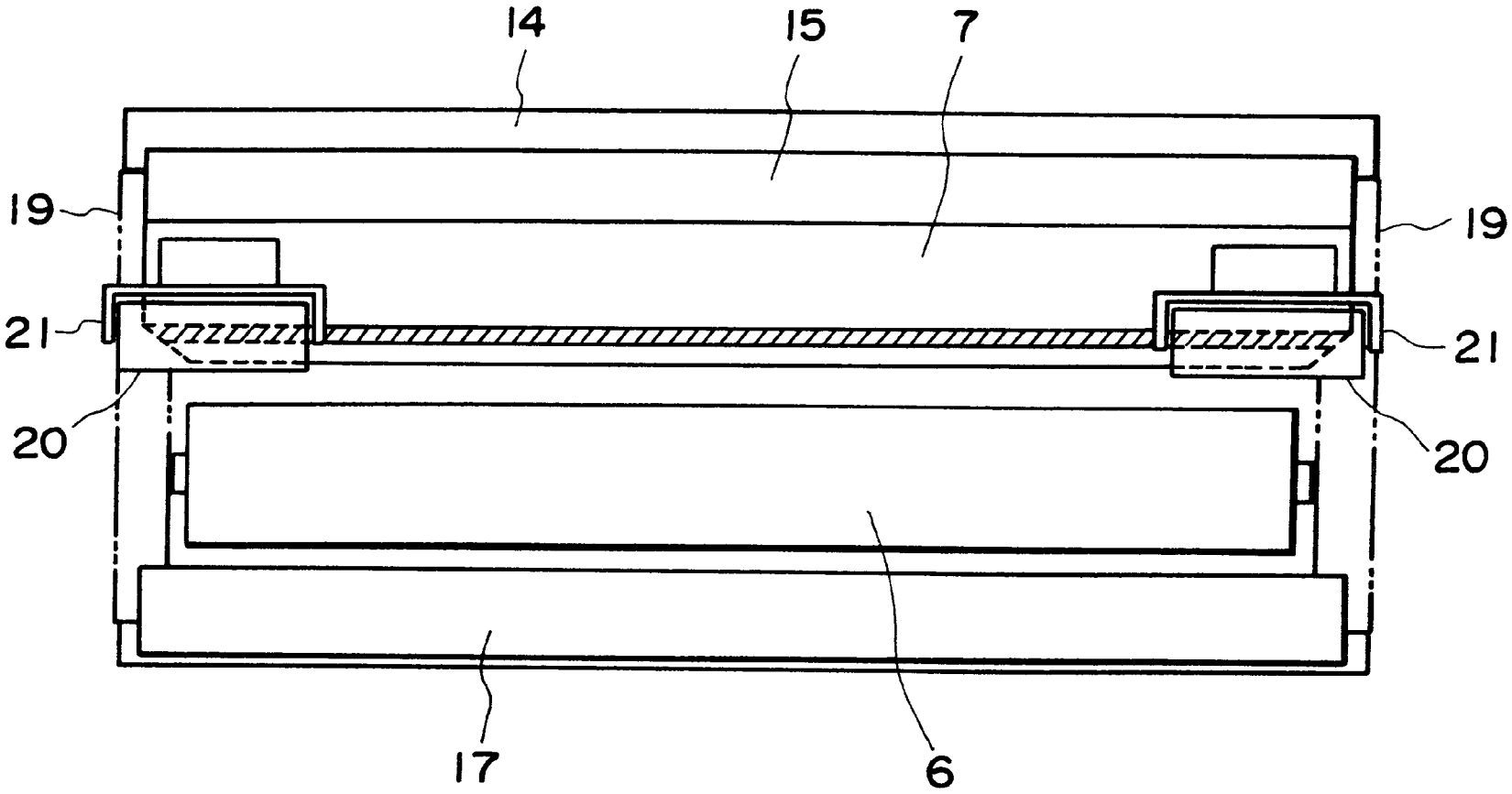
FIG. 20 shows a developing device according to Embodiment 5, as seen from the photosensitive member, wherein the developing sleeve is omitted for better understanding.

FIG. 20 shows a further embodiment of the present invention.

According to this embodiment, the developing device is provided with an inclined cutting at each of the opposite ends of the elastic blade 7, and end roller 20 (toner charging roller, press-contact elastic member) is provided at each of the opposite longitudinal end portions of the developing sleeve 5.

More particularly, as shown in FIG. 20, the distance from the contact nip between the elastic blade 7 and the developing sleeve 5 indicated by hatched portion in the Figure to the edge of the elastic blade 7, continuously decreases toward the opposite ends of the elastic blade 7 away from the normal developing zone, and the blade end position at each of the opposite ends is within the contact nip. The toner layer thickness formed on the developing sleeve 5 is thicker if the distance from the upstream end of the contact nip in the rotational direction of the developing sleeve 5 to the edge is longer, as is known. In this embodiment, such a distance is made shorter in the portion in the end portion than in the normal developing zone, at the region contacting to the surface of the developing sleeve, corresponding to the non-contact portion of the elastic roller 6, by which the regulating force to the toner is enhanced in the region.

In this embodiment, similarly to Embodiment 4, the end rollers (toner charging roller) 20 electrically charge, using electric discharging, the toner 8 in the thin layer at the opposite ends of the non-image area of the developing sleeve 5. The end rollers 20 are rubber rollers of NBR, and are urged to the developing sleeve 5 by urging member 21 with the contact force of 100–200 gF. By contacting the end rollers 20, the toner 8 is densely filled or packed so that toner is uniformly applied.

The longitudinal positional relation between the end roller 20 and the inclined cut portion at the opposite ends of the elastic blade 7, as shown in FIG. 20, is preferably such that the cut portion is assuredly covered.

When the elastic blade 7 is provided with the inclined cut at each of the opposite ends, the toner 8 tends to be packed in the nip adjacent the ends of the elastic blade 7, with the result that elastic blade 7 is raised at the opposite ends of the nip by the packed toner. Then, the thickness of the toner layer gradually increases in lines, and therefore, the electrical attraction force (mirror force) to the developing sleeve 5 decreases. Even if this occurs, the electrical attraction force to the developing sleeve 5 is maintained by the charging (using electric discharge) to the toner by means of the end rollers 20. Therefore, the transfer of the toner 8 to the photosensitive drum 1 at the background area (fog) and/or the falling of the toner 8 from the surface of the developing sleeve 5 to the outside with the result of contamination of the inside of the image forming apparatus (toner leakage), can be avoided.

To the cut portion at each of the opposite ends of the elastic blade 7, the toner 8 is fed with the rotation of the developing sleeve 5, and it extends toward the end along the edge side surface with a great number of developing operations repeated. Such toner 8 enters through the small gaps formed by the end seal member 19, the developing sleeve 5 and each of the opposite ends of the elastic blade 7. As a result, such a surface of the end seal member 19 contacted to the developing sleeve 5 is gradually covered by the toner 8, and the developing sleeve 5 is scraped by the sliding between the seal member 17 and the developing sleeve 5. The scraping of the developing sleeve 5 deteriorates the charging of the toner 8 and deteriorates the electrical attraction force (mirror force) to the developing sleeve 5. However, the electrical attraction force to the developing sleeve 5 recovers by the charging (using electric discharge) to the toner 8 by the end rollers 20, so that transfer of the toner 8 to the photosensitive drum 1 at the background area (fog) and/or the falling of the toner 8 from the surface of the developing sleeve 5 to the outside with the result of remarkable contamination of the inside of the image forming apparatus, can be avoided with certainty.

<Embodiment 6>

Figure 21:
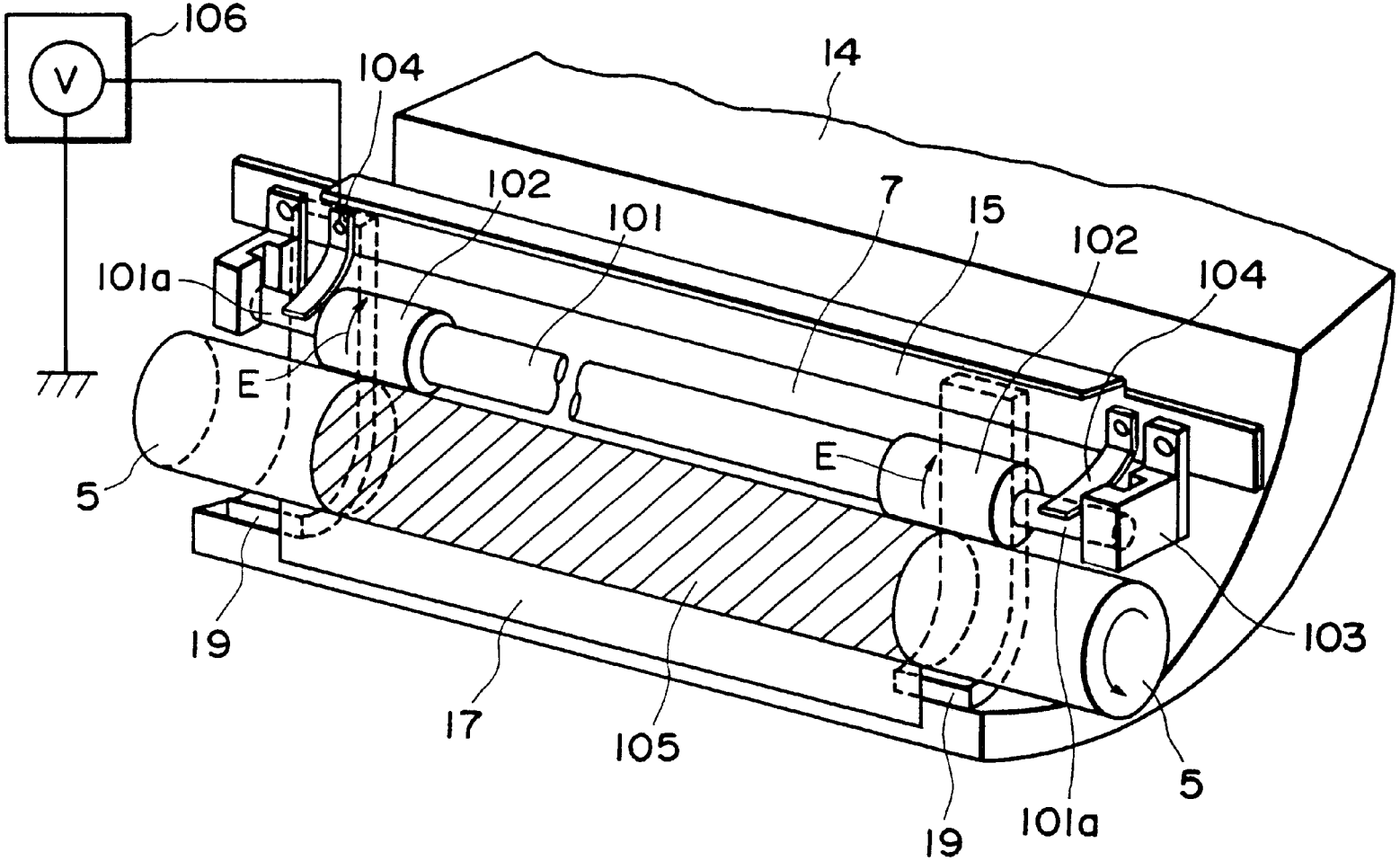
FIG. 21 is a perspective view of a toner charging member disposed at each of opposite ends of a developing sleeve in a developing device according to Embodiment 6.

FIG. 21 shows a further embodiment of the present invention.

In this embodiment, the toner charging rollers 102 are integrally mounted to the neighborhoods of the opposite ends of the center shaft 101 which is parallel with the developing sleeve 5, and the edge portions 101*a* of the shaft 101 are engaged with grooves of slide bearings 103, so that the shaft is rotatable and movable toward the developing sleeve 5 along the groove. Each of the slide bearings 103 is mounted to the developing container 14 through a supporting metal plate 15 supporting the elastic blade 7.

The charging roller 102 is contacted to both of the toner coating region 105 of the surface of the developing sleeve 5 and the non-toner coated region immediately outside thereof, at each longitudinal end portions of the developing sleeve 5. The charging roller 102 is press-contacted by a pressing spring 104 mounted to the supporting metal plate 15 and by the weights of the charging roller 102 and the center shaft 101 themselves. The charging roller 102 press-contacted to the developing sleeve 5 is driven by the developing sleeve 5 in the direction indicated by an arrow E.

The charging rollers 102 and the center shaft 101 are of electroconductive metal, and the pressing springs 104 are of electroconductive material. The pressing spring 104 is electrically connected with a bias voltage source 106, so that charging roller 102 is supplied with a bias voltage of the same polarity as the charge polarity of the toner 8, through the pressing spring 104 and the center shaft 101 from the voltage source 106, during the developing operation. By this, the charge of the same polarity as the charge polarity is applied to the toner 8 which is fed to the charging roller 102 on the developing sleeve 5 and which is press-contacted to the charging roller 102.

In this embodiment, the operations were confirmed with the following conditions:

the volume resistivity of the charging roller 102 and the center shaft 101: $10^6$ Ωcm or lower:

the nonmagnetic toner 8: negative toner:

voltage to the charging roller 102: DC voltage of −300V—600V.

It has been confirmed that toner press-contacted by the charging roller 102 at the ends of the developing sleeve 5 is provided with the charge of the same polarity as the charge polarity, and that toner passes by the seal member 17 at the lower portion of the opening of the developing container 14 while the attraction force to the surface of the developing sleeve 5 is maintained, and is assuredly collected back into the developing container 14. Although the volume resistivity of the charging roller 102 and the center shaft 101 was not more than $10^6$ Ωcm, no electrical leakage occurred since the toner is between the developing sleeve 5 and the charging roller 102. However, if the applied voltage is raised in an attempt to raise the charge amount of the toner, the leakage limit between the developing sleeve 5 and the charging roller 102 may be exceeded, and therefore, the volume resistivity of the charging roller 102 and the center shaft 101 is preferably higher than that.

<Embodiment 7>

Figure 22:
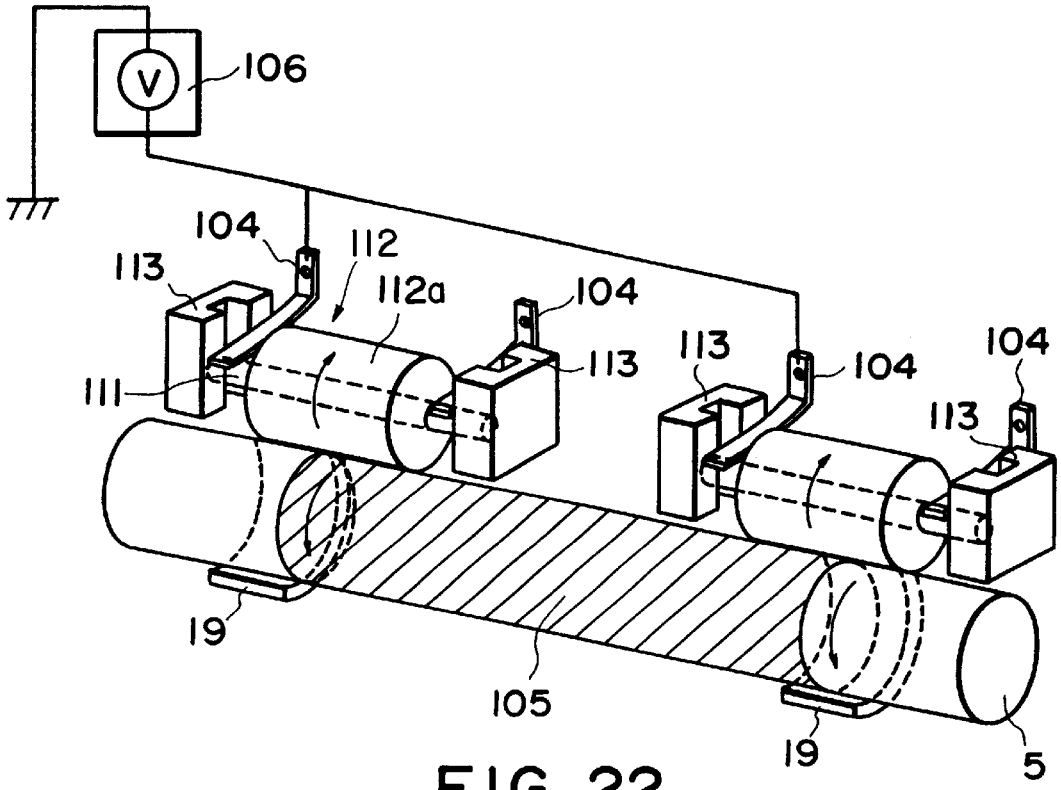
FIG. 22 is a perspective view of a toner charging member in Embodiment 7 according to an embodiment of the present invention.

FIG. 22 shows a further embodiment of the present invention.

In this embodiment, separate charging rollers 112 are disposed at the end portions of the developing sleeve 5. Each of the charging rollers 112 comprises a hollow elastic member 112(*a*) and a center shaft 111 of metal press-fitted therein, and the opposite ends of the shaft 111 are rotatably and movably engaged with grooves of slide bearings 113. To the opposite ends of the center shaft 111, pressing springs 104 of electroconductive material are pressed to urge the charging roller 112 toward the developing sleeve 5 and to establish an electrical conduction state therebetween. The slide bearing 113 and the pressing spring 104 are mounted to a supporting metal plate which is not shown but which is similar to the supporting metal plate 15 of FIG. 21. In FIG. 22, the same reference numerals as in FIG. 21 are assigned to the elements having the corresponding functions, and detailed descriptions thereof are omitted for simplicity.

In this embodiment, the charging roller 112 is an elastic roller having a volume resistivity of $10^8$–$10^{10}$ Ωcm. In this embodiment, the charging roller 112 is supplied with a voltage of −500V—800V at 1 mA, and it has been confirmed that charge is applied to the toner at the end of the developing sleeve 5, so that toner has sufficient deposition force to the developing sleeve 5.

<Embodiment 8>

Figure 23:
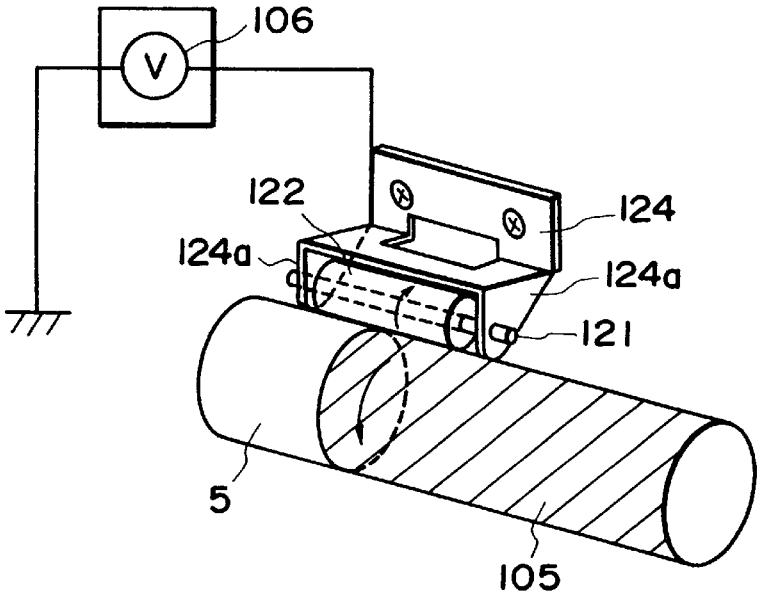
FIG. 23 is a perspective view of a toner charging member according to Embodiment 8 of the present invention.

FIG. 23 shows a further embodiment of the present invention.

In this embodiment, a leaf spring 124 having a couple of mounting frames 124*a* is provided adjacent each end portion of the developing sleeve 5, and a center shaft 121 of the charging roller 122 is supported between the frames 124*a*. The charging roller 122 is contacted to the surface of the developing sleeve 5 at each of the end portions.

In this embodiment, the leaf spring 124 functions both as a supporting member for the charging roller 122 and as a pressing spring, so that space is saved, and the structure is simplified as compared with the embodiment of FIG. 21.

As regards the embodiments of FIGS. 21, 22 and 23, simulation tests have been carried out for the cases of the charging rollers 102, 112 and 122 being installed in the developing device 4 with the following conditions:

the outer diameter of the charging roller: 6–12 mm the pressure to the developing sleeve 5: proper level in the range of 50–200 grf the contact width: 6–12 mm:

the applied voltage: −500V the current value setting: 0.1 mA

It has been confirmed that toner is provided with the electrical charge at the opposite ends of the developing sleeve while being rotated by the charging roller press-contacted to the developing sleeve 5 at each of the end portions thereof, so that sufficient deposition force is given to the developing sleeve, and it has been visually confirmed that toner is passed by the seal member 17 at the lower portion of the opening of the developing container 14 without being separated from the developing sleeve 5 and is collected back into the developing container 14. When the applied voltage to the charging roller is rendered OFF in such a state, it has been confirmed that toner at the opposite ends of the developing sleeve 5 is disengaged from the developing sleeve 5 and is unable to pass by the seal member 17 with the result of toner leakage and scattering.

Additionally, checking has been made as to what will happen if the charging member is not driven by the developing sleeve 5. If the resistance is such that the charging roller is not rotated with the result of peripheral speed difference existing between the peripheries of the charging roller and the developing sleeve 5, the toner particles in the toner coating region 105 on the surface of the developing sleeve 5 in FIG. 21, are dammed by the charging roller and are separated from the developing sleeve 5, so that toner leakage or scattering occurs. Therefore, it is preferable that the charging roller is driven by the developing sleeve 5.

<Embodiment 9>

Figure 24:
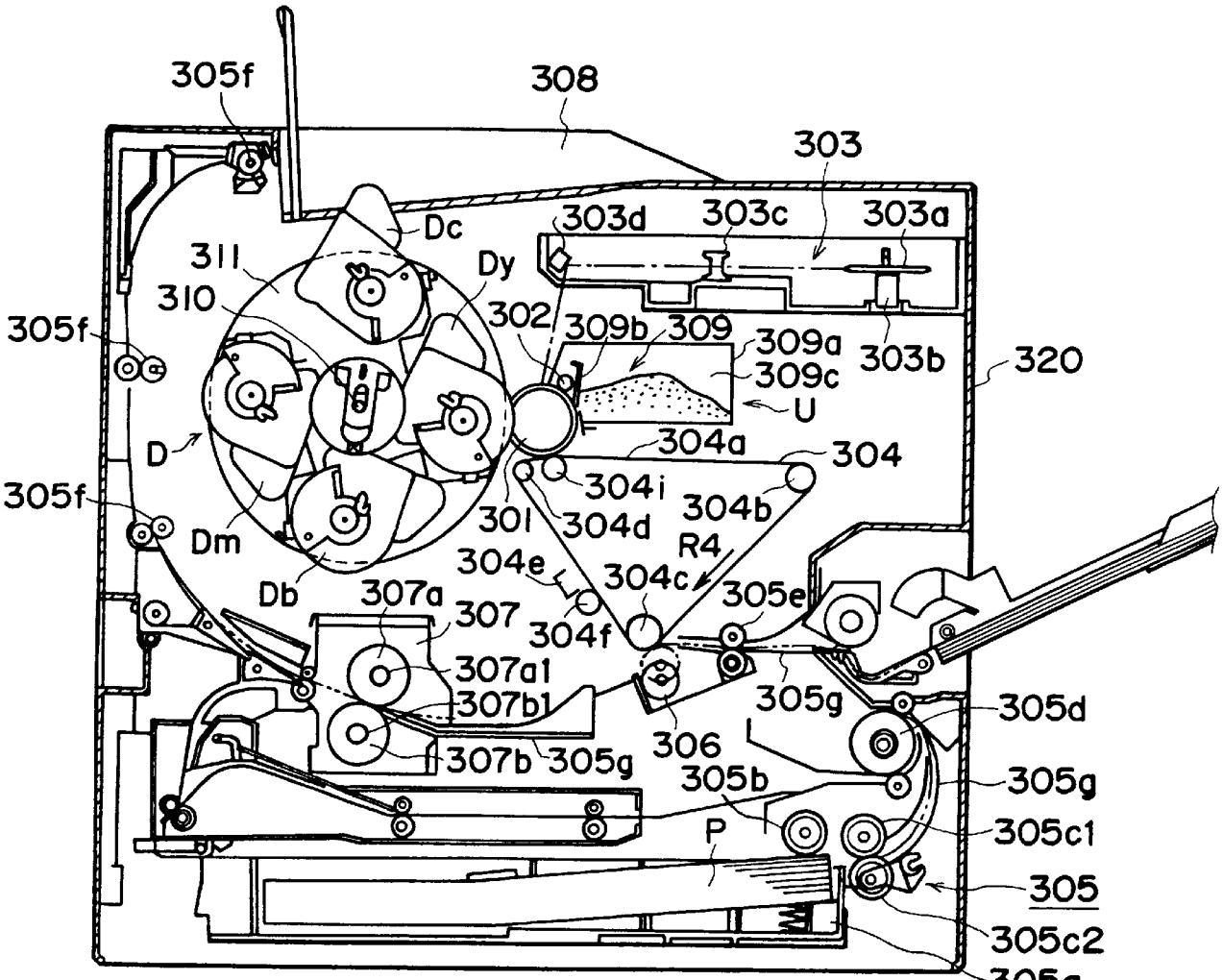
FIG. 24 ia a sectional view of an image forming apparatus using a developing device according to Embodiment 9.

FIG. 24 is a sectional view of a color printer of an electrophotographic type as an image forming apparatus using a developing device according to an embodiment of the present invention.

A charging means 302 uniformly charges a surface of an electrophotographic photosensitive member in the form of a drum (photosensitive drum) 301 (image bearing member) which is rotating at a constant speed. A laser beam is projected to the photosensitive drum 301 from an exposure means 303 in accordance with image information to form a latent image on the photosensitive drum 301. The latent image is developed by four developing cartridges Dm, Dc, Dy and Db (simply called hereinafter D). The developed images formed on the photosensitive drum 301 are superimposedly transferred onto an intermediary transfer member 304 in the form of a belt sequentially, so that a full-color image is formed. The color image is transferred by transferring means 306 onto a recording material (recording paper, OHP sheet or the like) fed from a feeding portion by feeding means 305. The recording material P is fed to fixing means 307 where the color image is fixed, and the recording material P is discharged to the discharging portion 308 at the upper surface of the apparatus.

Each part of the apparatus will be described in detail.

The photosensitive drum 301 is integral with a frame 309*a* of a process cartridge U in the form of a container for cleaning means 309 which functions to remove residual toner remaining on the photosensitive drum 301 after transfer of the developer (toner) image onto the intermediary transfer member 304. The process cartridge U is detachably mountable relative to the main assembly 320 of the image forming apparatus, and it can be replaced with a fresh one after the end of the lifetime of the photosensitive drum 301, by the user.

The photosensitive drum 301 comprises an aluminum cylinder having a diameter of approximately 50 mm and an organic photoconductive layer thereon, and is rotatably supported on the frame 309*a* for the cleaning means 309, which frame 309*a* functioning also as a holder for the photosensitive drum 301. On the peripheral surface of the photosensitive drum 301, there are provided a cleaning blade 309*b* for removing the toner remaining on the photosensitive drum 301 therefrom and charging means 302. Thus, in this embodiment, the photosensitive drum 301, the cleaning means 309 and the charging means 302 are contained as a unit in a process cartridge U detachably mountable to a main assembly 320 of the apparatus.

The photosensitive drum 301 is rotated in the counterclockwise direction in FIG. 24 in accordance with image forming operation by transmission of driving force from a driving motor.

The charging means 302 in this embodiment is a contact charging method type, and functions to uniformly charge the surface of the photosensitive drum 301.

The exposure means 303 exposes the charged photosensitive drum 301 to image light, and projects, onto the polygonal mirror 303*a,* the image light corresponding to an image signal through an unshown laser diode when the image signal is supplied to the laser diode. The polygonal mirror 303*a* is rotated at a high speed by a scanner motor 303*b,* and the image light reflected by the polygonal mirror 303*a* is projected selectively onto the surface of the photosensitive drum 301 which is rotating at a constant speed through an imaging lens 303*c* and reflection mirror 303*d,* thus forming an electrostatic latent image.

The electrostatic latent image is developed by the developing cartridge (developing device) D for each color. The toner image developed by the developing cartridge D, is transferred onto the intermediary transfer member 304 (transfer unit).

The transfer unit 304 (second image bearing member) functions to effect a secondary transfer, all at once onto the recording material P, of the toner images superimposed sequentially from the photosensitive drum 301, and is provided with an intermediary transfer belt 304*a* traveling in the direction indicated by an arrow R4. In this embodiment, the intermediary transfer belt 304*a* has a circumferential length of approximately 440 mm, and is stretched around a driving roller, 304*b,* a secondary transfer opposing roller 304*c* and a follower roller 304*d.*

A confining roller 304*i* is provided adjacent to the follower roller 304*d* which is movable between a position for urging the intermediary transfer belt 304*a* toward the photosensitive drum 301 and a position for keeping the intermediary transfer belt 304*a* away from the photosensitive drum 301. The intermediary transfer belt 304*a* travels in the direction indicated by arrow R4 by the rotation of the driving roller 304*b.*

At a predetermined position outside the intermediary transfer belt 304*a,* there is a cleaning unit 304*e* movable toward and away from the intermediary transfer belt 304*a,* and the untransferred toner remaining after the secondary transfer is removed thereby. The cleaning unit 304*e* includes a charging roller 304*f* for being contacted to the intermediary transfer belt 304*a* and for applying charge of the polarity opposite from that during the transfer to the toner. The toner provided with the charge of the opposite polarity, is deposited electrostatically to the photosensitive drum 301, and then, is collected by a cleaning device 309 for the photosensitive drum 301 which will be described hereinafter. The cleaning method for the intermediary transfer belt 304*a,* is not limited to the electrostatic cleaning, but may be a mechanical method using a blade or a fur brush, or both of them may be used at the same time.

The toner remaining on the surface of the photosensitive drum 301 after the transfer of the toner image onto the intermediary transfer member 304, is removed by cleaning means 309, which uses a cleaning blade 309*b* contacted to the surface of the photosensitive drum 301 to scrape the toner off the drum surface into the residual toner container 309*c.* The residual toner container 309*c* is formed by the cleaning frame 309*a.* The capacity of the residual toner stored in the residual toner container 309*c* is large enough so as not to be filled before the end of the lifetime of the photosensitive drum 301, and the residual toner in the residual toner container 309*c* is disposed of together with the exchange of the process cartridge U when the lifetime of the photosensitive drum 301 is reached.

The transferring means 306 for transferring, onto the recording material P, the toner image superimposedly transferred onto the intermediary transfer member 304, is in the form of a transfer roller 306 which comprises a metal shaft wrapped with an intermediate resistance elastic foam, and which is movable vertically in FIG. 24.

After the color image is formed by the superimposing transfer of the toner images onto the intermediary transfer member 304, the transfer roller 306 is moved to an upper position indicated by chain lines in FIG. 24 by a cam not shown, at proper timing. By this, the transfer roller 306 is press-contacted to the intermediary transfer member 304 at a predetermined pressure by way of the recording material P. Simultaneously therewith, a bias voltage is applied to the transfer roller 306, and the toner image is transferred from the intermediary transfer member 304 onto the recording material P.

The feeding means 305 for feeding the recording material P, as shown in FIG. 24, comprises a sheet feeding cassette 305*a* accommodating a plurality of recording materials P, a pick-up roller 305*b,* a sheet feeding roller 305*c*1, a retarding roller 305*c*2 for preventing double feeding, a pair of feeding rollers 305*d,* a pair of registration rollers 305*e,* a pair of discharging rollers 305*f* and feeding guides 305*g.*

During an image forming operation, the pick-up roller 305*b* is rotated in accordance with the image forming operation to separate the recording materials P one by one from the sheet feeding cassette 305*a.* The recording material P fed out of the sheet feeding cassette 305*a* is guided by the feeding guide 305*g,* and is fed to the pair of registration rollers 305*e* through the feeding rollers 305*d.* During the image forming operation, the registration rollers 305*e* we selectively either at rest to stop the recording material P or rotated for feeding the recording material P to the intermediary transfer member 304 in a predetermined sequence to make alignment between the image and the recording material P in the subsequent transfer process, and the color image is formed by the transferring means 306 as described above.

The recording material P now having the transferred color image is fed to the fixing means 307 where the toner is fixed. The fixing means 307 comprises a fixing roller 307*a* for applying heat to the recording material P, and a pressing roller 307*b* for press-contacting the recording material P to the fixing roller 307*a,* wherein both of the rollers 307*a,* 307*b* are hollow rollers, and contain therein heaters 307*a*1, 307*b*1, respectively. By feeding the recording material P while applying the heat and the pressure, the toner image is fixed onto the recording material P.

(developing device (developing cartridge))

The description will be made as to a structure of the developing device for developing a latent image formed on the photosensitive drum 301.

The image forming apparatus includes four developing devices D (Dy, Dm, Dc and Db) for developing yellow, magenta, cyan and black images, respectively. The developing devices D are detachably mounted on a rotary unit 311 rotatable about a shaft 310. In the image formation, the developing devices D are rotated about the shaft 310 while being held on the rotary unit 311. When a predetermined one of the developing devices D is faced to the photosensitive drum 301, the rotation is stopped. The developing sleeve of the developing device thus stopped is positioned with a small clearance (approximately 300 $\mu$m) relative to the photosensitive drum 301, and then the toner is supplied to the electrostatic latent image on the photosensitive drum 301 to develop the latent image.

During the color image formation, the rotary unit 311 is rotated for each of the rotations of the intermediary transfer belt 304*a,* so that a developing process is carried out by the yellow developing device Dy accommodating the yellow color toner, the magenta developing device Dm accommodating the magenta color toner, the cyan developing device Dc accommodating the cyan chromatic toner and the black developing device Db accommodating the black color toner in this order.

Figure 29:
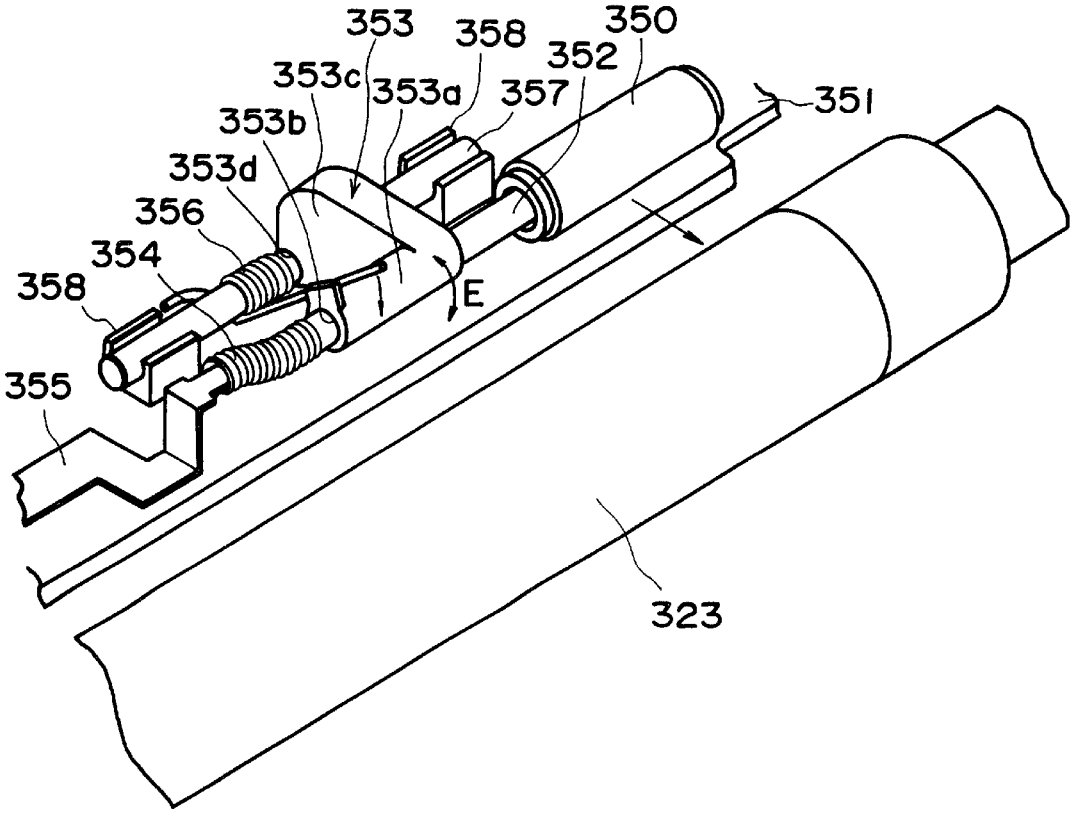
FIG. 29 is a perspective view of a major part of a developing device according to Embodiment 11.

FIG. 29 shows a developing device D (e.g. A yellow developing device Dy) which is positioned and disposed faced to the photosensitive drum 1 (developing position).

Figure 25:
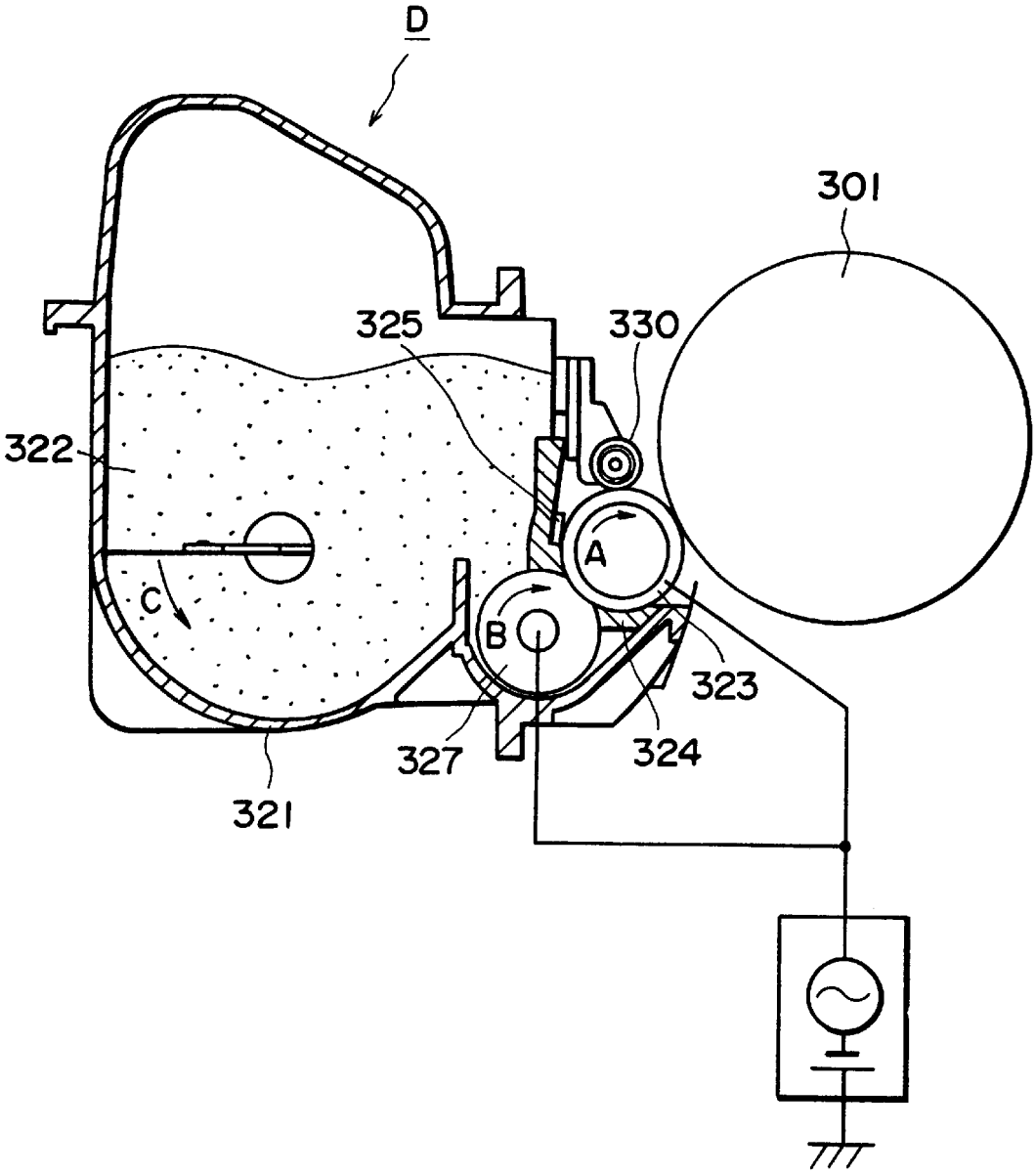
FIG. 25 is a sectional view of a developing device according to Embodiment 9.

In FIG. 25, the developing device D has a developing container 321 accommodating insulative nonmagnetic toner 322 as an one-component developer, and a developing sleeve 323 (developer carrying member) which is disposed in an opening extended in the longitudinal direction of the developing container 321 and which is faced to the photosensitive drum 301 to develop the electrostatic latent image on the photosensitive drum 301.

In the developing device D, substantially the left half of the circumference of the developing sleeve 323 is in the developing container 321, and substantially the right half thereof is exposed to the outside. The exposed surface is faced to the photosensitive drum 1 with a small clearance.

The developing sleeve 323 is rotated in a direction indicated by arrow A, and the surface has proper roughness to provide high contact probability with the toner 322 and to improve the carrying of the toner 322. In this embodiment, it is a sleeve of aluminum having a diameter of 16 mm, and the surface thereof is subjected to regular blast treatment using glass beads(#600) into the surface roughness Rz of approximately 3 $\mu$m. It is faced to the photosensitive drum 1 with a gap of 300 $\mu$m therebetween. The peripheral speed is 80 mm/s which is slightly higher than the peripheral speed of the photosensitive drum 301, namely, 50 mm/s.

In order to prevent toner leakage at the opposite ends of the developing sleeve 323, end seal members 324 are provided at the opening of the developing container 321 to seal the opposite ends of the developing sleeve 323.

Above the developing sleeve 323, an elastic blade 325 is supported on a blade supporting metal plate 326, and a part thereof adjacent the free end is surface-contacted to the outer surface of the developing sleeve 323 counterdirectionally (the free end is upstream of the contact portion relative to the rotational direction of the developing sleeve 323). The elastic blade 325 comprises rubber material such as urethane and silicon or includes a base member of an upper part position of SUS or phosphor bronze having a spring elasticity and a rubber material on the side of the base member contacted to the developing sleeve 323. The elastic blade 325 of this embodiment includes a blade supporting metal plate 326 and an urethane rubber in the form of a plate having a thickness of 1.0 mm bonded thereto. The contact force relative to the developing sleeve 323 is 23–35 g/cm (the line pressure is measured in this manner: three thin metal plates having known friction coefficients are inserted into the contact portion, and the center portion one is pulled out through a spring weigher, and the read of the spring weigher is converted).

An elastic roller 327 is disposed upstream of the contact portion between the elastic blade 325 and the surface of the developing sleeve 323 with respect to the rotational direction of the sleeve 323, and is supported rotatably. The structure thereof is preferably, a foam skeleton sponge structure, or a fur brush structure having a metal core and fibers of rayon, Nylon or the like planted therein, from the standpoint of supply of the toner 322 onto the developing sleeve 323 and removal of the toner not used for the development. In this embodiment, the use is made of an elastic roller 327 having a diameter of 12 mm including a metal core and polyurethane foam thereon. A width of the nip between the elastic roller 327 and the developing sleeve 323 is preferably 1–8 mm, and it is preferable to provide a relative speed relative to the developing sleeve 323 at the contact portion. In this embodiment, the width is 3 mm, and the elastic roller 327 is rotated at a peripheral speed of 50 mm/s during the developing operation (the relative speed relative to the developing sleeve 323 is 130 mm/s) by unshown driving means at predetermined timing.

The description will be made as to a developer charging roller for applying a charge to the toner. As shown in FIG. 25, the charging roller 330 is contacted to the developing sleeve 323 at a position downstream of a contact portion between the elastic blade 325 and the developing sleeve 323 with respect to the rotational direction of the developing sleeve, and electrically charges the tonere 322 in the thin layer while being driven by the developing sleeve 323.

Figure 26:
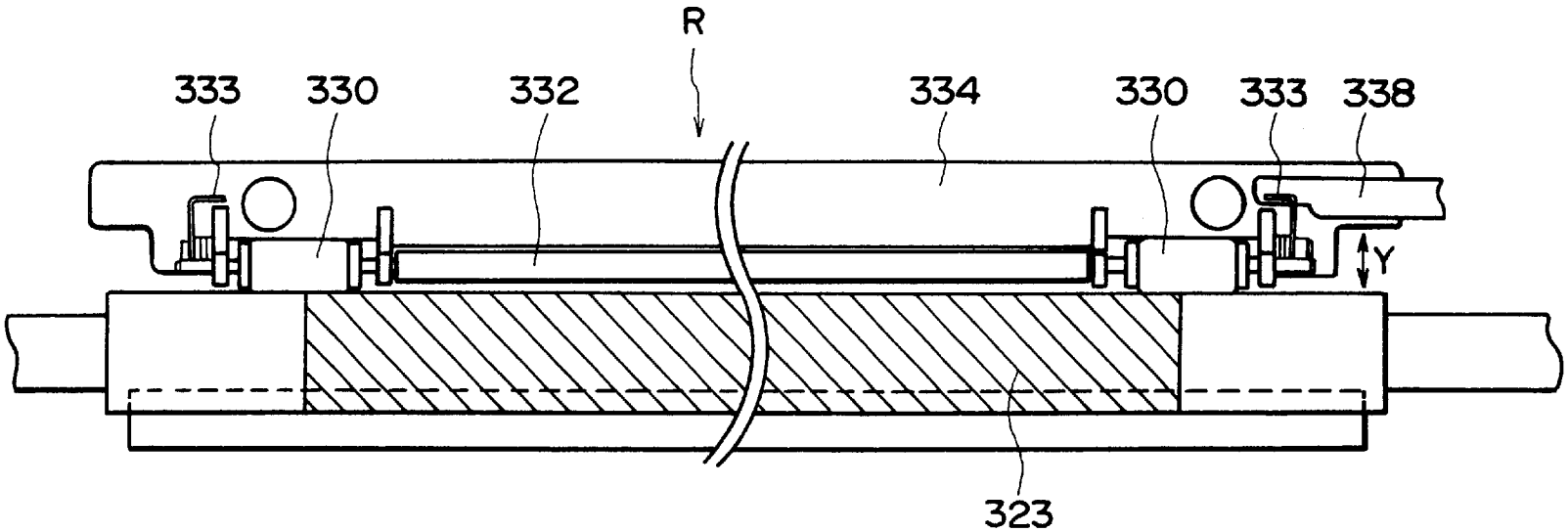
FIG. 26 shows a developing device of Embodiment 4 as seen from the photosensitive member, wherein the developing sleeve is shown.

FIG. 26 is a view of the developing device D provided with the charging roller 330, as seen from the photosensitive drum 301. The charging roller 330 is supported by a roller supporting shaft 332 extended parallel with the developing sleeve 323, and is contacted to the developing sleeve 323. The roller supporting shaft 332 is mounted on a base plate 334 for movement in the direction of an arrow Y, and is pressed by a pressing member 333 toward the developing sleeve 323 with the force of 170 gF. The charging roller 330, the roller supporting shaft 332 and the pressing member 333 are mounted to the base plate 334 and constitute a roller unit R, which is mounted to the developing container 321.

The charging roller 330 is contacted to both of a non-toner coated portion (non-hatched portion 323*a* in FIG. 26) and toner coating portion (hatched portion 323*b* in FIG. 26) on the developing sleeve 323. The toner charging roller 330 makes slipping action if the contact is only at the toner coating portion, since the flowability of the toner is high, and therefore, it is not stably driven. To solve the problem, it is contacted to the non-coated portion. The charging roller 330 is preferably driven by the developing sleeve 323 or is driven otherwise but by the same peripheral speed as the developing sleeve 323. If there is a peripheral speed difference between the charging roller 330 and the developing sleeve 323, the toner coating is non-uniform with the result of the transfer of the toner to the background area (fog) or scattering or leakage of the toner.

The bias voltage source and the bias voltage are the same as the ones used in the above-described embodiments.

Figure 27:
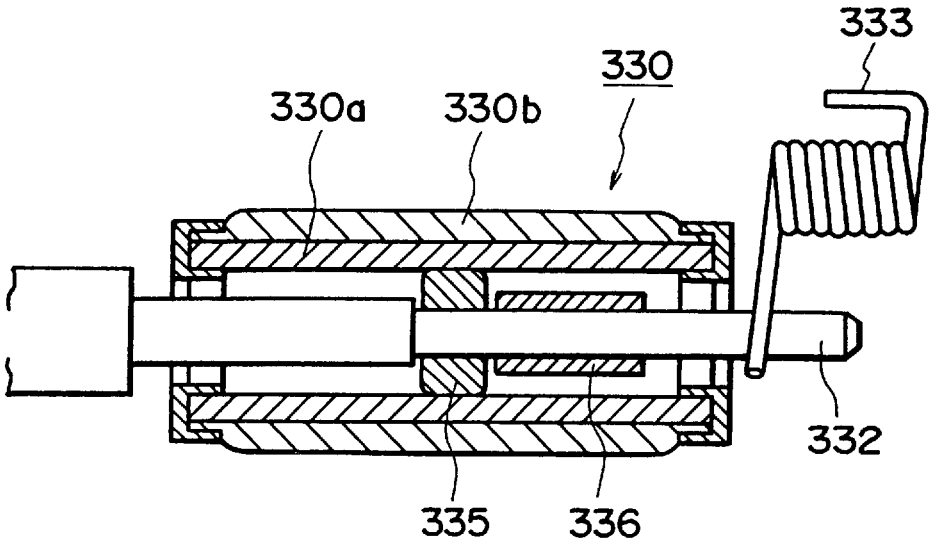
FIG. 27 is a sectional view of a charging roller according to Embodiment 9.

FIG. 27 is a sectional view of a charging roller 330. The charging roller 330 comprises a metal core 330*a* which is a tube of brass and a rubber layer 330*b* thereon. In the charging roller 330, there is a bearing 335 for bearing the roller supporting shaft 332. The roller supporting shaft 332 is provided with a retainer 336 press-fitted thereto. The roller supporting shaft 332 is pressed by a pressing member 333 such as a coil spring or the like. The pressing member 333 also functions as an electrode for applying a bias voltage to the charging roller 330, and receives the charging roller bias branched out of the developing bias from the electrode 338 (FIG. 26), and applies it to the charging roller 330 through the roller supporting shaft 332 and the bearing 335.

By the disposition of the bearing 335 in the charging roller 330, the scattering toner or another foreign matter is prevented from entering the bearing 335, so that rotation of the charging roller 330 is stabilized, and simultaneously, the charging roller unit can be downsized. By the application of the bias voltage to the charging roller 330 through the bearing 335, there is no need of an additional electrode, so that cost reduction is accomplished.

According to this embodiment, occurrence of the uncharged toner is prevented at the opposite longitudinal end portions, and the thin toner layer can be stably formed.

<Embodiment 10>

Figure 28:
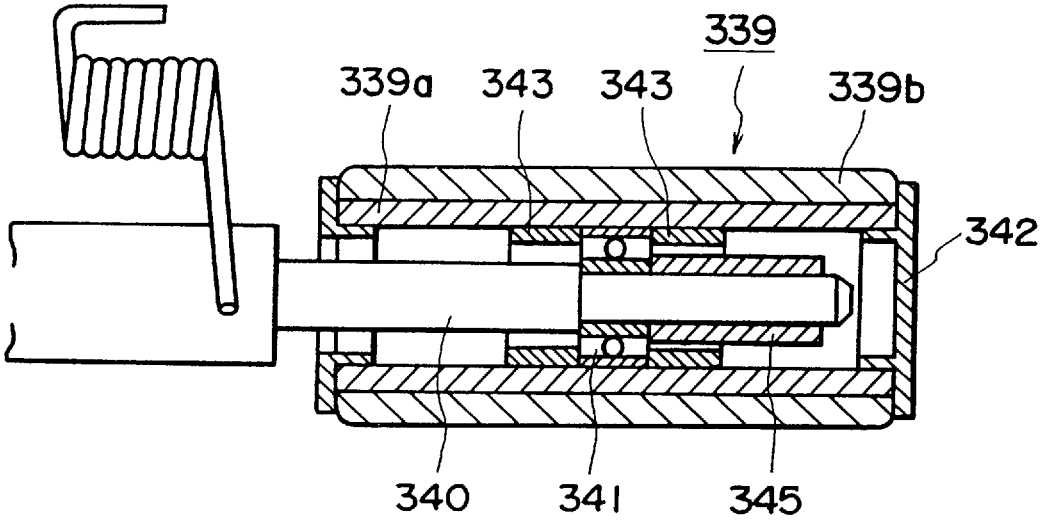
FIG. 28 is a sectional view of a charging roller according to Embodiment 10.

FIG. 28 shows a further embodiment of the present invention.

The structures of the image forming apparatus and the developing device are the same as those in the ninth embodiment.

The charging roller 339 in this embodiment comprises a metal core 339*a* and a rubber layer 339*b* thereon similarly to the ninth embodiment. A roller bearing 341 is used for supporting the supporting shaft 340 of the roller, and fixed members 343 are press-fitted around the metal core 339*a* at the sides to fix the bearing 341. A roller retainer 345 is press-fitted around the supporting shaft 340 to retain the roller 339 on the supporting shaft 340. At each of the ends of the roller 339, a cap member 342 is mounted to cover the opening of the metal core 339*a*.

In this embodiment, the used bearing 341 has little play (several $\mu$m) between the inner and outer races to provide the charging roller 339 with a center alignment mechanism relative to the developing sleeve 323. By doing so, the charging roller 339 can be inclined relative to the supporting shaft 340, so that it is aligned relative to the developing sleeve 323 during rotation, and the charging roller 339 is assuredly contacted to the developing sleeve 323. A cap member 342 may be provided at the end of the charging roller 339 to prevent the scattering toner or another foreign matter from entering the bearing 341 during the image forming operation, so that the charging roller 339 can be rotated stably for a long term.

With this structure, uniform and stable application of the electrical charge to the uncharged toner on the developing sleeve is accomplished, thus assuredly preventing production of the uncharged toner and accomplishing a stabilized thin toner layer on the developing sleeve.

In this embodiment, the roller bearing has play, so that charging roller is provided with a center alignment mechanism function. Alternatively, use may be of an automatic alignment type roller bearing, or the supporting shaft may be given the center alignment mechanism function.

<Embodiment 11>

Figure 30:
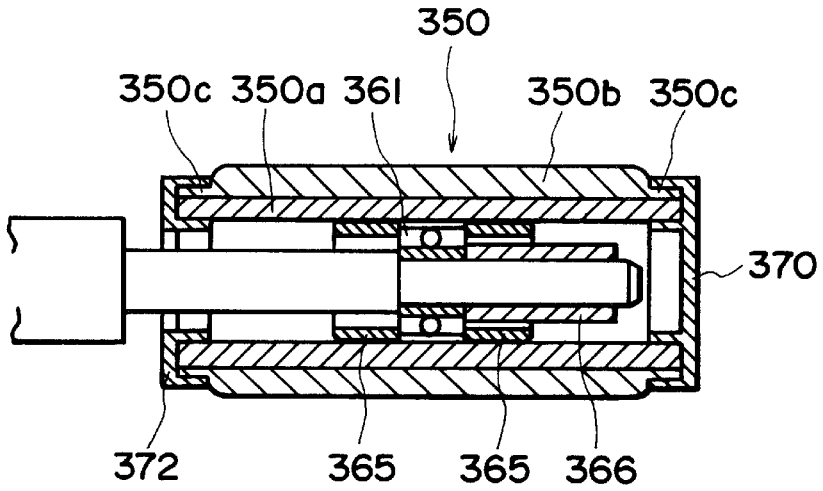
FIG. 30 is a sectional view of a charging roller according to Embodiment 11.

Referring to FIGS. 29 and 30, the description will be made as to a further embodiment. The structure of the image forming apparatus in the embodiment is the same as the ninth embodiment.

In FIG. 29, charging roller 350 is rotatably supported on the supporting shaft 352, and is press-contacted to the developing sleeve 323. The supporting shaft 352 is engaged with a hole 353*b* formed in the cylindrical portion 353*a* of the arm 353 and is penetrated therethrough, and the opposite portion of the charging roller 350 is connected with an electrode spring 354 and an electrode plate 355 to permit application of the bias to the charging roller 350.

A second supporting shaft 357 is engaged with and penetrated through a through-hole 353*d* formed at a fulcrum portion 353*c* of the arm 353 parallel with the supporting shaft 352, and the opposite ends of the second supporting shaft 357 are supported rotatably on a supporting table 358 fixed on a base plate 351. Around the second supporting shaft 357, a pressing member 356 of the spring member is wound, and one end thereof is contacted to the base plate 351, and the other end is contacted to the cylindrical portion 353*a* of the arm 353, so that arm 353 is swingable about the second supporting shaft 357 in the direction of an arrow E to press-contact the charging roller 350 to the developing sleeve 323 by urging force of the pressing member 356.

Similarly to the tenth embodiment, the charging roller 350 is provided with a function of a center alignment mechanism relative to the developing sleeve 323, and is assuredly contacted to the developing sleeve 323 to apply the charge to the toner while being driven by the developing sleeve 323.

FIG. 30 shows a structure of the charging roller 350. The charging roller 350 of this embodiment comprises a metal core 350*a* of a brass tube, a rubber layer 350*b* molded thereon, a roller bearing 361, bearing fixing members 365 and retainers 366 therein, similarly to the tenth embodiment. In this embodiment, thin portions 350*c* are provided at the opposite ends of the rubber layer 350*b* of the charging roller 350 (the thickness is smaller than in the central portion), the thin portions are covered by caps 370 and 372.

With such a structure, the foreign matter is prevented from entering the bearing 361 by the caps 370 and 372, and simultaneously, the facing distance between the metal core 350*a* and the developing sleeve 323 can be enlarged, so that leakage can be prevented. Therefore, uniform and stable application of the electrical charge to the uncharged toner on the developing sleeve is accomplished, thus assuredly preventing production of the uncharged toner and accomplishing a stabilized thin toner layer on the developing sleeve.

While the invention has been described with reference to the structures disclosed herein, it is not confined to the details set forth and this application is intended to cover such modifications or changes as may come within the purposes of the improvements or the scope of the following claims.

What is claimed is:

1. A developing device comprising:

a developer container for accommodating a developer;

a developer carrying member, disposed in an opening of said developer container, for carrying a layer of a developer; and a developer charging member for being contacted to the developer on said developer carrying member and supplied with a voltage of the same polarity as the developer and not less than a discharge starting voltage at which electric discharge starts between the layer of the developer carried on said developer carrying member and said developer charging member.

2. A developing device according to claim 1, further comprising a regulating member for regulating an amount of the developer on said developer carrying member, wherein said developer charging member is disposed downstream of a regulating portion of said regulating member and upstream of a developing zone of said developer carrying member with respect to a moving direction of said developer carrying member.

3. A developing device according to claim 2, wherein the layer of the developer on said developer carrying member, regulated by said regulating member, has a thickness of 10–20 mircrons.

4. A developing device according to claim 1, wherein said developer charging member includes a charging roller which is driven by said developer carrying member or is driven at the same peripheral speed.

5. A developing device according to claim 3, wherein said charging roller is provided with a bearing therein.

6. A developing device according to claim 4, wherein said charging roller is provided with a center alignment mechanism.

7. A developing device according to claim 4, wherein said charging roller is supplied with a voltage through said bearing.

8. A developing device according to claim 1, wherein said developer charging member is extended along a longitudinal direction of said developer carrying member.

9. A developing device according to claim 1, wherein the developer is a one-component developer.

10. A developing device according to claim 8, wherein the developer is nonmagnetic.

11. A developing device according to claim 8, wherein the developer has a shape factor SF-1 of 100–180 and a shape factor SF-2 of 100–140.

12. A developing device according to claim 1, wherein said developer charging member has a surface rubber layer.

13. A developing device according to claim 1, wherein said developing device is in the form of a unit detachably mountable to an image forming apparatus.

14. A developing device according to claim 1, wherein said developing device is integral with an image bearing member for carrying an electrostatic image and constitutes a process unit detachably mountable to an image forming apparatus.

15. A developing device comprising:

a developer container for accommodating a developer;

a developer carrying member, disposed in an opening of said developer container, for carrying a layer of a developer;

a developer charging member being contacted to the developer on said developer carrying member and supplied with a voltage of the same polarity as the developer and not less than a discharge starting voltage at which an electric discharge starts between the layer of the developer carried on said developer carrying member and said developer charging member; and a regulating member for regulating an amount of the developer on said developer carrying member, wherein said developer charging member is disposed downstream of a regulating portion of said regulating member and upstream of a developing zone of said developer carrying member with respect to a moving direction of said developer carrying member, and wherein said developer charging member is provided at an end of said developer carrying member.

16. A developing device according to claim 14, wherein said developer charging member is extended to an outside of an end of said developer carrying member.

17. A developing device according to claim 14, wherein said developer carrying member has a non-carrying region which does not carry the developer at an end portion, and said developer charging member is contacted also to the non-carrying region.

18. A developing device according to claim 15, wherein the layer of the developer on said developer carrying member, regulated by said regulating member, has a thickness of 10–20 mircrons.

19. A developing device comprising:

a developing container for accommodating a developer;

a developer carrying member, disposed in an opening of said developing container, for carrying a developer;

a regulating member for regulating an amount of the developer on said developer carrying member;

a developer charging member for being contacted to the developer on said developer carrying member and supplied with a voltage of the same polarity as the developer, wherein said developer charging member is disposed downstream of a regulating portion of said regulating member and upstream of a developing zone of said developer carrying member with respect to a moving direction of said developer carrying member, and said developer charging member is disposed at a position corresponding to an end of said developer carrying member.

20. A developing device according to claim 19, wherein said developer charging member includes a charging roller which is driven by said developer carrying member or is driven at the same peripheral speed.

21. A developing device according to claim 20, wherein said charging roller is provided with a bearing therein.

22. A developing device according to claim 21, wherein said charging roller is provided with a center alignment mechanism.

23. A developing device according to claim 21, wherein said charging roller is supplied with a voltage through said bearing.

24. A developing device according to claim 19, wherein said developer charging member is extended to an outside of an end of said developer carrying member.

25. A developing device according to claim 19, wherein the developer is a one-component developer.

26. A developing device according to claim 25, wherein the developer is nonmagnetic.

27. A developing device according to claim 25, wherein the developer has a shape factor SF-1 of 100–180 and a shape factor SF-2 of 100–140.

28. A developing device according to claim 19, wherein said developer charging member has a surface rubber layer.

29. A developing device according to claim 19, wherein said developer carrying member has a non-carrying region which does not carry the developer at an end portion, and said developer charging member is contacted to the non-carrying region.

30. A developing device according to claim 19, wherein said developing device is in the form of a unit detachably mountable to an image forming apparatus.

31. A developing device according to claim 19, wherein said developing device is integral with an image bearing member for carrying an electrostatic image and constitutes a process unit detachably mountable relative to an image forming apparatus.

32. A developing device charging roller for charging a developer, comprising:

a contact portion; and a bearing, provided inside of said charging roller, for supporting a shaft.

33. A developing device charging roller according to claim 32, wherein said charging roller is provided with a center alignment mechanism.

34. A developing device charging roller according to claim 32, wherein said charging roller is supplied with a voltage through said bearing.

* * * * *

UNITED STATES PATENT AND TRADEMARK OFFICE

CERTIFICATE OF CORRECTION

PATENT NO. : 6,229,979 B1
DATED : May 8, 2001
INVENTOR(S) : Yasuyuki Ishii et al.

It is certified that error appears in the above-identified patent and that said Letters Patent is hereby corrected as shown below:

Column 2,
Line 60, “are” should read -- is --.

Column 3,
Line 49, “advantages” should read -- advantageous --.
Line 50, “have” should read -- has --.
Line 51, “is” should read -- to be --.

Column 5,
Line 6, “ia” should read -- is --.

Column 6,
Line 31, “an” should read -- a --.
Line 61, “understating.” should read -- understanding --.

Column 12,
Line 28, “Where” should read -- where --.

Column 14,
Line 14, “not” should read -- no --.
Line 39, “are” should read -- is --.

Column 16,
Line 65, “portions” should read -- portion --.

Column 20,
Line 66, “we” should read -- are --.

Column 22,
Line 52, “tonere” should read -- toner --.

Column 25,
Line 30, “claim 3,” should read -- claim 4, --.
Line 32, “claim 4,” should read -- claim 5, --.
Line 35, “claim 4,” should read -- claim 5, --.
Line 43, “claim 8,” should read -- claim 9, --.
Line 45, “claim 8,” should read -- claim 9, --.

UNITED STATES PATENT AND TRADEMARK OFFICE

CERTIFICATE OF CORRECTION

PATENT NO. : 6,229,979 B1 
DATED : May 8, 2001
INVENTOR(S) : Yasuyuki Ishii et al.

It is certified that error appears in the above-identified patent and that said Letters Patent is hereby corrected as shown below:

Column 26,
Line 12, “claim 14,” should read -- claim 15, --.
Line 15, “claim 14,” should read -- claim 15, --.
Line 23, “mircrons.” should read -- microns. --.

Signed and Sealed this

Thirteenth Day of August, 2002

*Attest:*

*Attesting Officer*

JAMES E. ROGAN
*Director of the United States Patent and Trademark Office*